US010071895B2

(12) United States Patent
Wang et al.

(10) Patent No.: US 10,071,895 B2
(45) Date of Patent: Sep. 11, 2018

(54) HOT FILL PROCESS WITH CLOSURES MADE FROM HIGH DENSITY UNIMODAL POLYETHYLENE

(71) Applicant: NOVA Chemicals (International) S.A., Fribourg (CH)

(72) Inventors: XiaoChuan Wang, Calgary (CA); Mark Rejman, Barrie (CA); Ronald William Lewoniuk, Rocky View County (CA); Ian Robert Gibbons, Calgary (CA); Eric Paul Brusset, Calgary (CA)

(73) Assignee: NOVA Chemicals (International) S.A., Fribourg (CH)

( * ) Notice: Subject to any disclaimer, the term of this patent is extended or adjusted under 35 U.S.C. 154(b) by 473 days.

(21) Appl. No.: 14/965,098

(22) Filed: Dec. 10, 2015

(65) Prior Publication Data

US 2017/0166430 A1 Jun. 15, 2017

(30) Foreign Application Priority Data

Dec. 9, 2015 (CA) ..... 2914315

(51) Int. Cl.

| | |
|---|---|
| ***B67C 3/22*** | (2006.01) |
| ***B67B 6/00*** | (2009.01) |
| ***B65D 41/04*** | (2006.01) |
| ***B67C 3/04*** | (2006.01) |

(52) U.S. Cl.

CPC ..... *B67C 3/22* (2013.01); *B65D 41/04* (2013.01); *B67B 6/00* (2013.01); *B67C 3/045* (2013.01); *B67C 2003/228* (2013.01)

(58) Field of Classification Search

CPC .. B65D 41/00; B65D 41/04; C08J 5/00; C08J 2323/00; C08J 2323/20

USPC ..... 53/425, 440

See application file for complete search history.

(56) References Cited

U.S. PATENT DOCUMENTS

| | | | | |
|---|---|---|---|---|
| 3,978,063 | A * | 8/1976 | Kishimoto | C07D 217/00 514/906 |
| 4,665,682 | A * | 5/1987 | Kerins | B29C 49/0005 264/37.31 |
| 5,292,845 | A | 3/1994 | Kawasaki et al. | |
| 5,342,868 | A | 8/1994 | Kimura et al. | |
| 5,376,439 | A | 12/1994 | Hodgson et al. | |
| 5,665,477 | A * | 9/1997 | Meathrel | A61B 5/04087 427/2.12 |
| 5,981,636 | A | 11/1999 | Amos et al. | |
| 6,465,551 | B1 | 10/2002 | Zhao et al. | |

(Continued)

FOREIGN PATENT DOCUMENTS

| | | | |
|---|---|---|---|
| WO | 93/03093 | A1 | 2/1993 |
| WO | 2005/121239 | A2 | 12/2005 |

(Continued)

OTHER PUBLICATIONS

Borealis; "Polyolefins Moulding Bottles"; Copyright 2007 by Borealis GmbH pp. 1-16; www.borealisgroup.com.*

(Continued)

*Primary Examiner* — Gloria R Weeks
(74) *Attorney, Agent, or Firm* — Julie L Heinrich

(57) ABSTRACT

High density (density ≥0.945 g/cm$^3$) unimodal polyethylene compositions for use in hot-fill closures and processes.

40 Claims, 8 Drawing Sheets

(56) References Cited

U.S. PATENT DOCUMENTS

| | | | | |
|---|---|---|---|---|
| 6,502,369 | B1 * | 1/2003 | Andison | B65B 3/022 53/275 |
| 6,599,971 | B2 | 7/2003 | Dotson et al. | |
| 7,361,275 | B2 * | 4/2008 | Wien | C02F 1/004 210/638 |
| 7,622,550 | B2 * | 11/2009 | Cha | C07K 14/43504 530/300 |
| 7,854,104 | B2 * | 12/2010 | Cronin | B65D 47/243 206/219 |
| 8,283,384 | B2 * | 10/2012 | Stewart | A61L 24/0015 514/772.1 |
| 8,293,867 | B2 * | 10/2012 | Messersmith | B05D 7/52 525/328.2 |
| 8,361,356 | B2 * | 1/2013 | Zang | C08L 51/006 264/4.1 |
| 8,567,164 | B2 * | 10/2013 | Thomasset | B65D 1/0207 426/401 |
| 8,652,565 | B2 * | 2/2014 | Komatsu | G02F 1/167 359/296 |
| 8,907,050 | B2 * | 12/2014 | Saleh | C04B 24/28 528/287 |
| 9,074,082 | B2 * | 7/2015 | Wang | C08L 23/0815 |
| 9,505,893 | B2 * | 11/2016 | Wang | C08F 2/001 |
| 2002/0188053 | A1 * | 12/2002 | Zang | C09J 153/00 524/474 |
| 2003/0087338 | A1 * | 5/2003 | Messersmith | B82Y 5/00 435/68.1 |
| 2005/0288398 | A1 * | 12/2005 | Messersmith | A61L 24/046 524/17 |
| 2008/0247984 | A1 * | 10/2008 | Messersmith | C08G 65/3317 424/78.02 |
| 2009/0230079 | A1 * | 9/2009 | Smolko | B65D 41/0442 215/261 |
| 2010/0137902 | A1 * | 6/2010 | Lee | A61L 24/001 606/213 |
| 2011/0062108 | A1 * | 3/2011 | Berthold | C08L 23/06 215/329 |
| 2011/0132864 | A1 * | 6/2011 | Jamtvedt | C08K 5/0008 215/329 |
| 2014/0311673 | A1 * | 10/2014 | Zhao | C09J 11/02 156/325 |
| 2016/0108185 | A1 * | 4/2016 | Wang | C08F 2/001 525/240 |

FOREIGN PATENT DOCUMENTS

| | | | |
|---|---|---|---|
| WO | 2011/050042 | A1 | 4/2011 |
| WO | 2015/042561 | A1 | 3/2015 |
| WO | 2015/042562 | A1 | 3/2015 |
| WO | 2015/042563 | A1 | 3/2015 |

OTHER PUBLICATIONS

Wang, XiaoChuan (Alan); Deformation Measurement, Modeling and Morphology Study for HDPE Caps and Closures; ANTEC 2015; Mar. 23-25, 2015, Orlando, FL—pp. 1-5.

Randall, James C.; A Review of High Resolution Liquid 13Carbon Nuclear Magnetic Resonance Characterizations of Ethylene-Based Polymers; JMS-Rev. Macromol. Chem. Phys., C29 (2 & 3); (1989) Copyright by Marcel Dekker, Inc.; p. 285.

ASTM D6474-99 (Reapproved 2006); Standard Test Method for Determining Molecular Weight Distribution and Molecular Weight Averages of Polyolefins by High Temperature Gel Permeation Chromatography; Copyright by ASTM International; pp. 1-6.

ASTM D5227-01 (Reapproved 2008); Standard Test Method for Measurement of Hexane Extractable Content of Polyolefins; Copyright by ASTM International; pp. 1-4.

ASTM D6645-01; Standard Test Method for Methyl (Comonomer) Content in Polyethylene by Infrared Spectrophotometry; Copyright by ASTM International; pp. 1-4.

ASTM D648-07; Standard Test Method for Deflection Temperature of Plastics Under Flexural Load in the Edgewise Position; Copyright by ASTM International; pp. 1-13.

ASTM D1525-09; Standard Test Method for Vicat Softening Temperature of Plastics; Copyright by ASTM International; pp. 1-10.

ASTM D2990-09; Standard Test Methods for Tensile, Compressive and Flexural Creep and Creep-Rupture of Plastics; Copyright by ASTM International; pp. 1-20.

ASTM D256-10; Standard Test Methods for Determining the Izod Pendulum Impact Resistance of Plastics; Copyright by ASTM International; pp. 1-20.

ASTM D790-10; Standard Test Methods for Flexural Properties of Unreinforced and Reinforced Plastics and Electrical Insulating Materials; Copyright by ASTM International; pp. 1-11.

ASTM D1238-10; Standard Test Method for Melt Flow Rates of Thermoplastics by Extrusion Plastometer; Copyright by ASTM International; pp. 1-15.

ASTM D792-13; Standard Test Methods for Density and Specific Gravity (Relative Density) of Plastics by Displacement; Copyright by ASTM International; pp. 1-6.

ASTM D1693-12; Standard Test Method for Environmental Stress-Cracking of Ethylene Plastics; Copyright by ASTM International; pp. 1-11.

* cited by examiner

HOT FILL PROCESS WITH CLOSURES MADE FROM HIGH DENSITY UNIMODAL POLYETHYLENE

The present disclosure relates to a hot filling process which employs closures made from high density (density ≥0.945 g/cm$^3$) unimodal polyethylene compositions.

Hot filling techniques are commonly used in the bottling of beverages such as, for example, drinks, fruit juices, milk, tea, sports drinks and flavored water. Typically, the material employed to package these materials in a hot fill application is polyethylene terephthalate (PET). PET bottles are light weight and tough.

A typical hot fill process involves the following steps. A hot liquid beverage is added to a plastic bottle while at an elevated temperature, typically from about 70 to about 93° C. under a positive pressure and over a 15 to 30 second time interval. The bottle or container is then immediately sealed with a plastic closure and tilted on its side or inverted. Contact of the hot liquid with the closure sterilizes the closure. Inversion may last for example, about 15 seconds, or a time sufficient for sterilization of the closure interior. Following sterilization of the closure interior, the bottle may be cooled to for example about 40° C.

In order to be properly applicable to a hot filling process the closure should be made of a material that imparts heat resistance (e.g. resistance to deformation during hot/cold cycles occurring in a hot filling process), good sealing properties to prevent leaking, and resistance to the development of cracks.

As discussed in a recent ANTEC® publication, *"Deformation Measurement, Modeling and Morphology Study for HDPE Caps and Closures"*, by XiaoChuan (Alan) Wang, Mar. 23-25, 2015, Orlando, Fla., USA, it is difficult to directly study the deformation properties of plastic closures due to their complex geometries and relatively small dimensions. Standard tests for creep properties (e.g. tensile creep, flexural creep, and compressive creep) such as those described in ASTM D-2990 employ standard compression molded specimens or plaques, not caps or closures per se. Further, the final polymer morphology, as it exists in a molded closure formed from injection molding or continuous compression molding techniques, may not be represented when using standardized testing which employ standardized plaques. As such, a method which informs about the deformation properties of a finished closure was developed. The method employed a model to evaluate the deformation of an "as is closure" at different instantaneous stresses, times and temperatures. To properly model the closure deformation, any tamper-evident ring attached to the closure was removed.

We have now found that application of the methodology and model to closures comprising high density unimodal polyethylene compositions allows one to select for polymer compositions which are particularly suitable for application in hot fill closures and processes.

The present disclosure shows that certain high density unimodal polyethylene compositions are suitable for making closures used in hot fill processes.

The preset disclosure also contemplates the use of high density unimodal polyethylene compositions for use in aseptic fill processes.

A recently developed model and a series of tests are used to demonstrate those closure characteristics which are suitable for hot fill, or aseptic fill applications.

Provided is a process to fill a container, the process comprising: adding a hot liquid to the container through a container opening, sealing the container opening with a closure comprising a unimodal polyethylene composition, and bringing the hot liquid into contact with an interior surface of the closure; wherein the unimodal polyethylene composition has a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

Provided is a use of a closure in a hot fill process, wherein the closure comprises a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

Provided is a process to fill a container, the process comprising: adding a hot liquid to the container through a container opening; sealing the container opening with a closure comprising a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2; and bringing the hot liquid into contact with an interior surface of the closure; wherein the closure has a time exponent, m of 0.114 or less where m is determined using a compressive strain model represented by the equation:

$$\varepsilon = A \times \sigma^n \times t^m$$

where ε is the compressive strain; σ is the stress in N/cm$^2$, t is the loading time in seconds, A is the model coefficient, n is the deformation stress exponent and m is the time exponent.

Provided is a use of a closure in a hot fill process, wherein the closure comprises a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; a molecular weight distribution $M_w/M_n$ of from 2.2 to 4.2; wherein the closure has a time exponent, m of 0.114 or less, where m is determined using a compressive strain model represented by the equation:

$$\varepsilon = A \times \sigma^n \times t^m$$

where ε is the compressive strain; σ is the stress in N/cm$^2$, t is the loading time in seconds, A is the model coefficient, n is the deformation stress exponent and m is the time exponent.

FILLING PROCESS

Figure 1A:
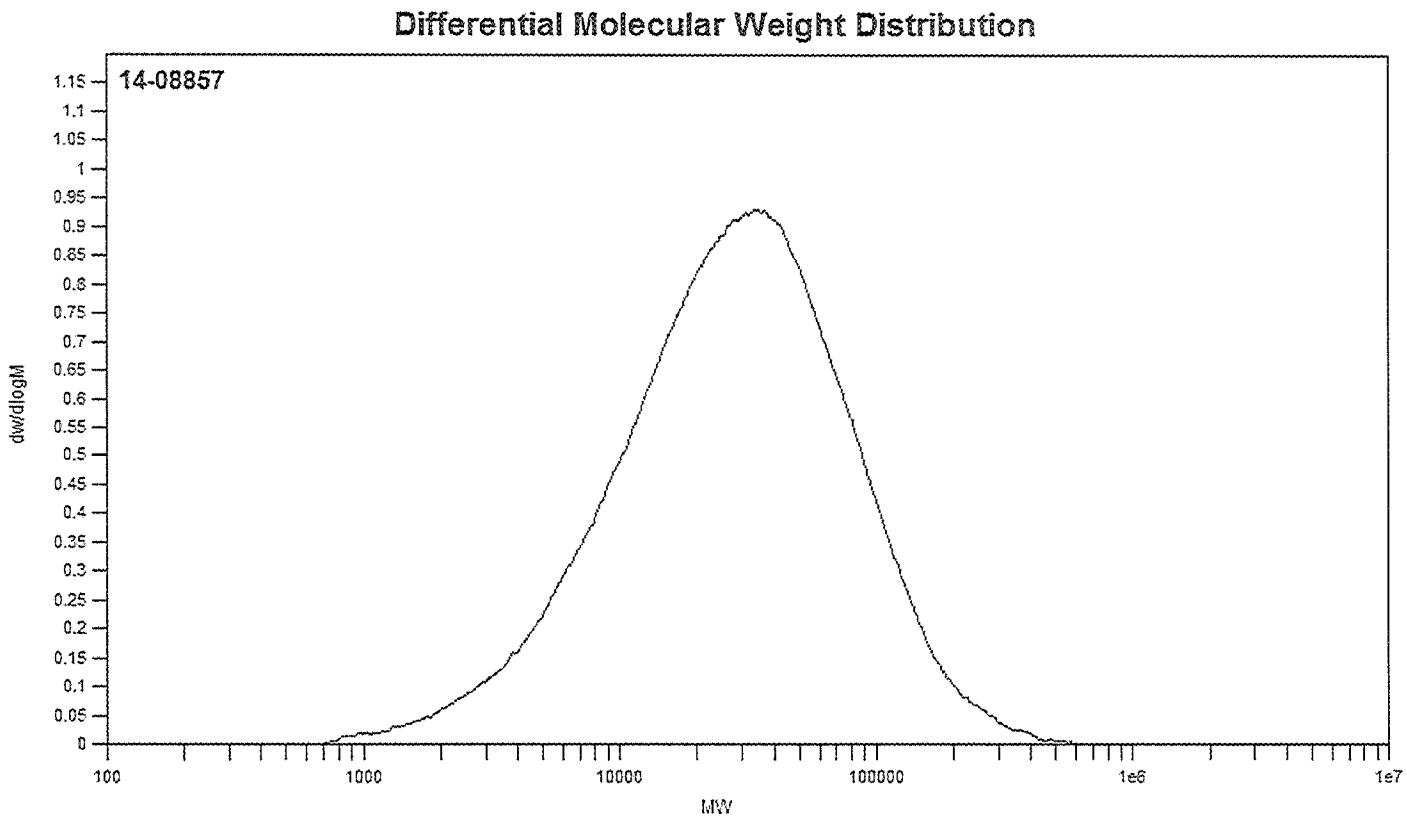
FIGS. 1A through 1E show gel permeation chromatographs for the unimodal polyethylene compositions used in Examples 1 through 5 respectively.
Figure 1B:
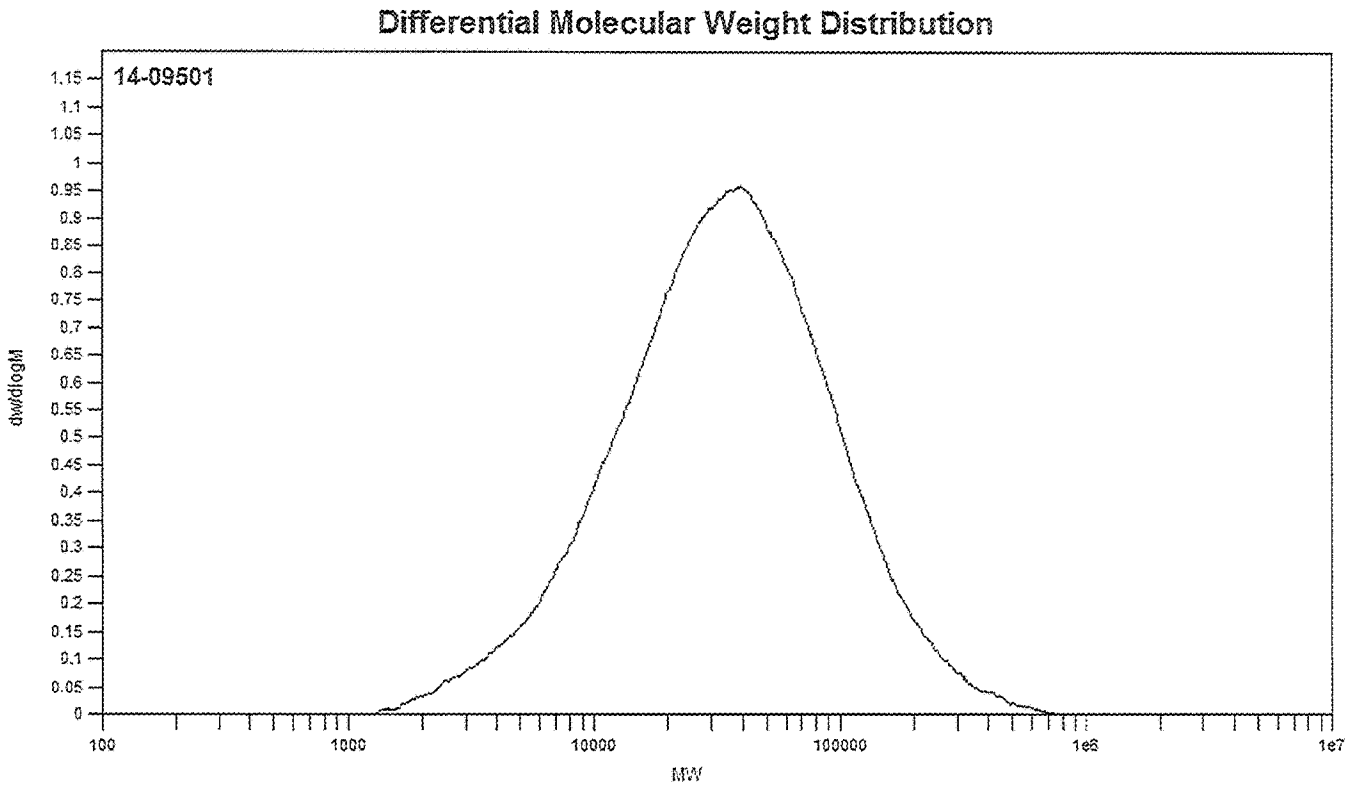
Figure 1C:
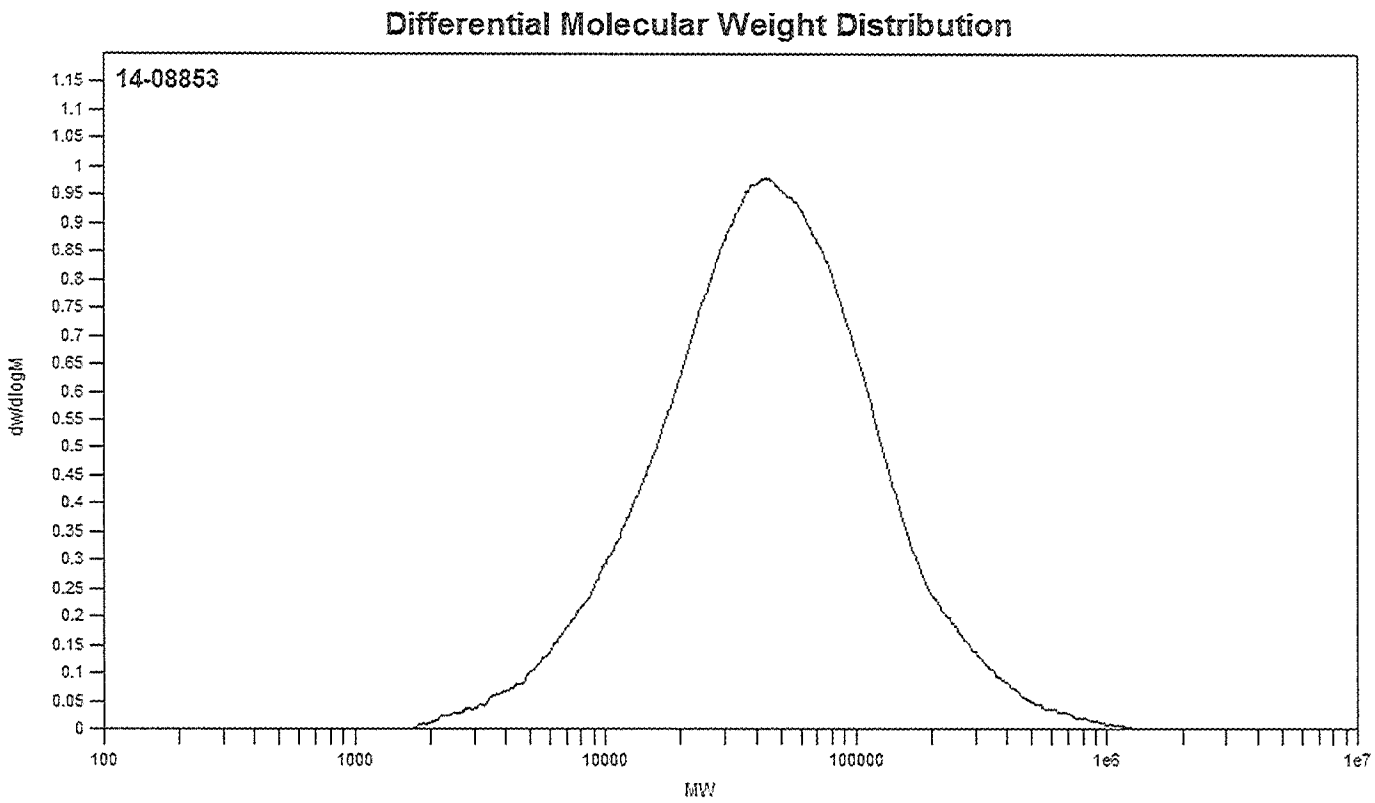
Figure 1D:
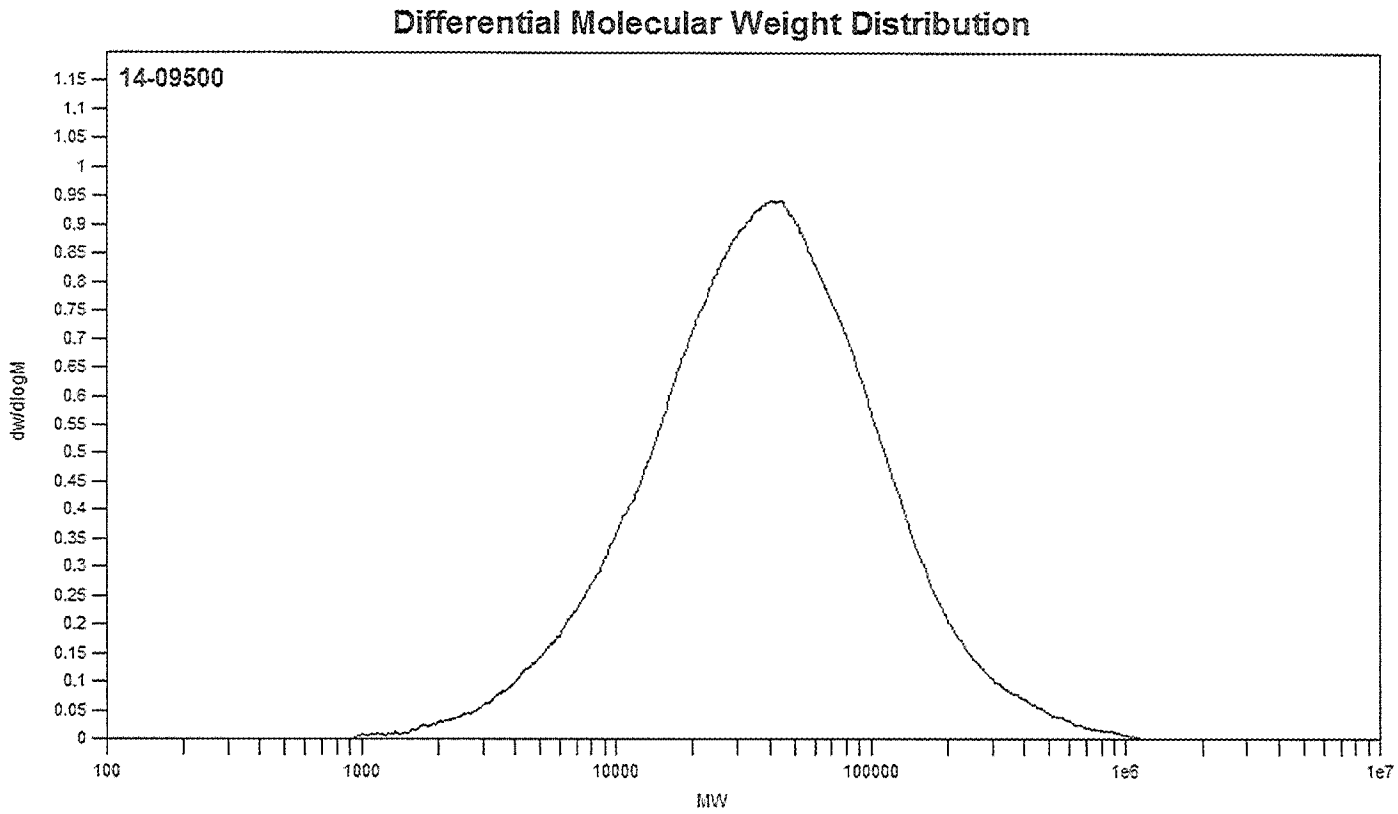
Figure 1E:
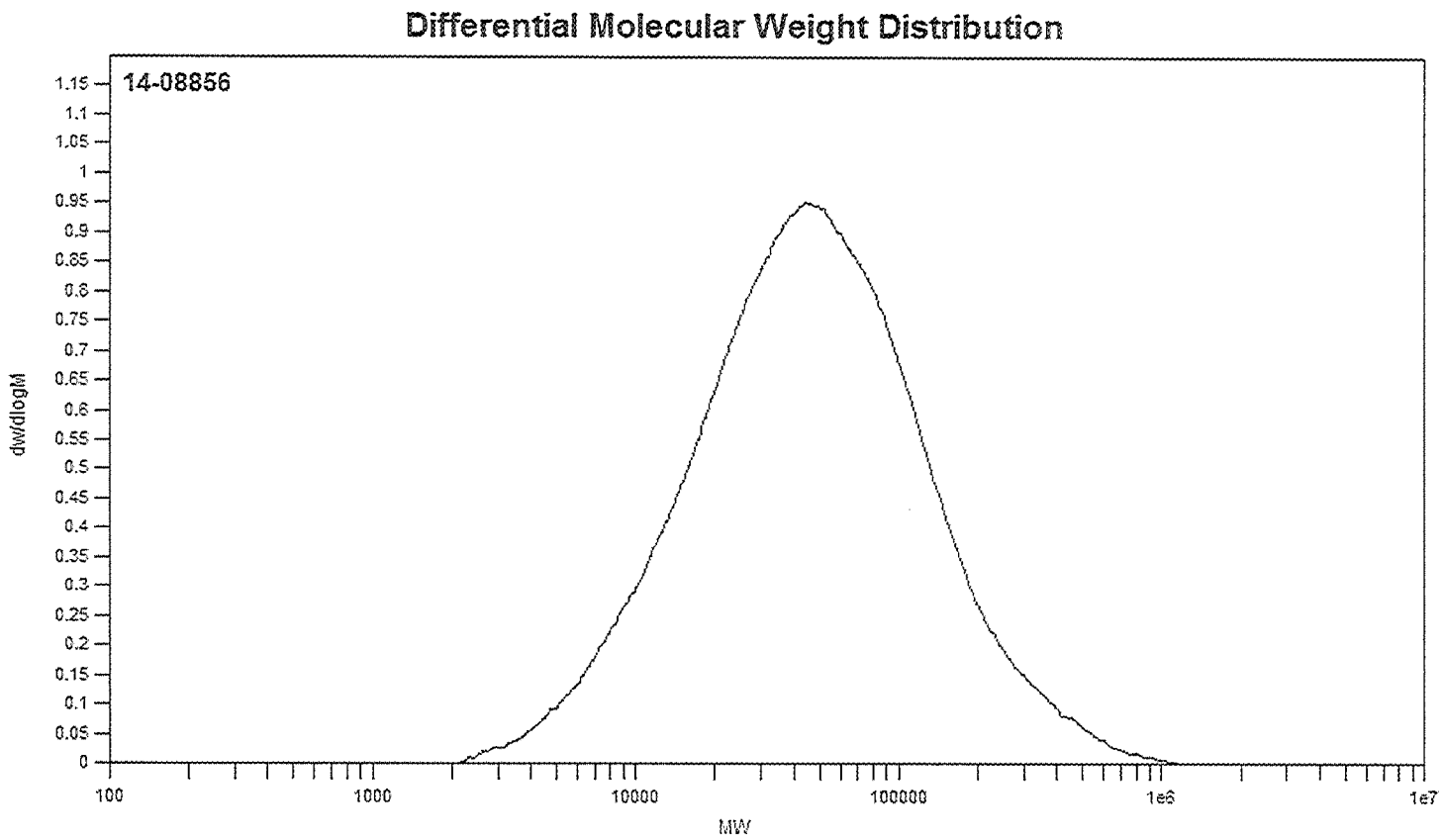
Figure 2A:
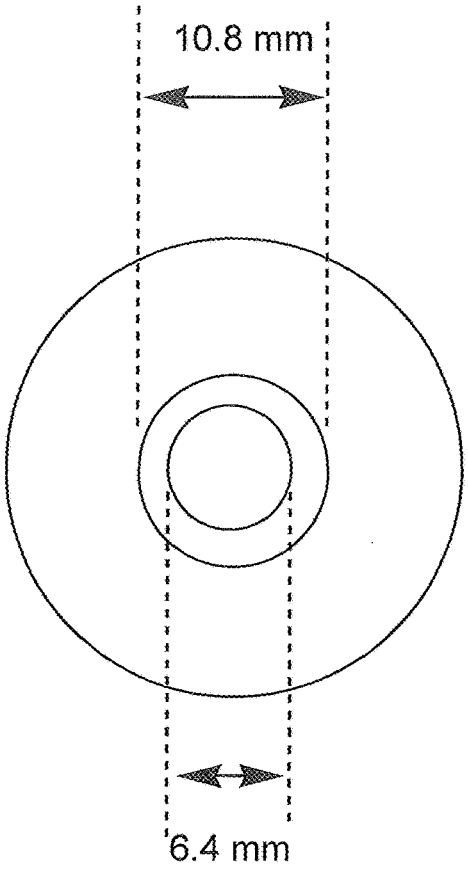
FIG. 2A shows an overhead cross sectional view of the probe used in the closure deformation testing. The view shows the bottom side of the probe which contacts the upper surface of the closure
Figure 2B:
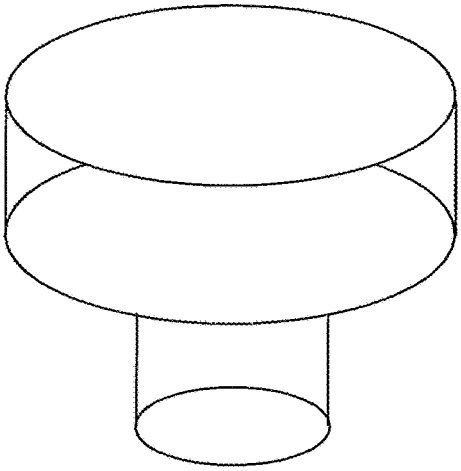
FIG. 2B shows a partial cross section perspective view of the probe used in the closure deformation testing.
Figure 3:
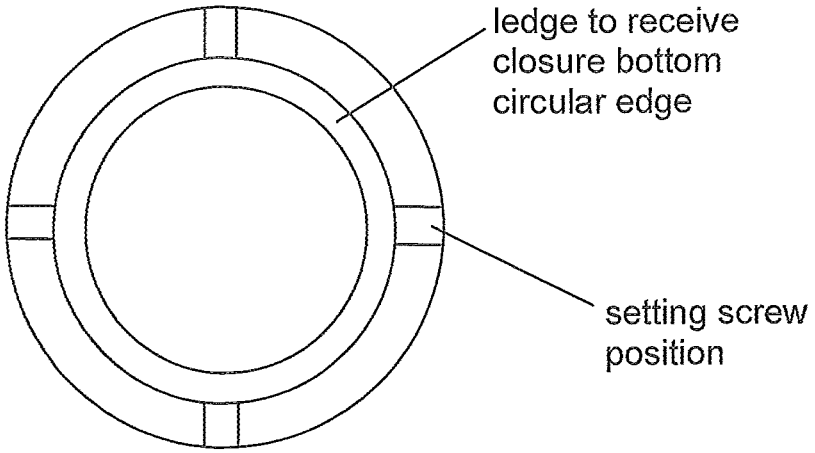
FIG. 3 shows an overhead view (with screw locations indicated) of the closure holder used in deformation stress testing. The view shows the upper surface of the holder which receives the lower annular edge of the closure.

The present disclosure is concerned with the use of closures in filling/sealing processes which have at least one step in which the closure interior (and optionally the container, bottle and the like) is (are) contacted with a liquid at elevated temperatures, or temperatures above ambient, or above room temperature or above about 20° C., or any temperature high enough to destroy microorganisms which may lead to illness when consumed (e.g. temperatures high enough to sterilize the closure and/or pasteurize the liquid). Processes which involve steps in which a closure is used to seal a container, bottle and the like containing a liquid at an elevated temperature include for example hot fill processes and in some cases aseptic fill processes. The disclosure is not limited to any particular end use or process so long as a closure is contacted with a liquid at elevated temperatures for the end use or during the process and is used to seal a container, bottle and the like.

In the present disclosure the terms "hot liquid" and "hot beverage" are used interchangeably, and connote that a liquid that has been heated to above ambient temperature or room temperature or above about 20° C., or any temperature high enough to destroy microorganisms which may lead to illness when consumed (e.g. temperatures high enough to pasteurize the liquid or beverage).

In embodiments of the disclosure, a hot liquid is a liquid that has been heated to from about 21° C. to about 150° C., and further including all numbers and narrower ranges within this range such as for example from about 70° C. to about 150° C., or from about 70° C. to about 145° C., or from about 80° C. to about 150° C., or from about 80° C. to about 145° C., or from about 21° C. to about 100° C., or from about 30° C. to about 100° C., or from about 30° C. to about 98° C., or from about 30° C. to about 95° C., or from about 30° C. to about 93° C., or from about 50° C. to about 100° C., or from about 50° C. to about 98° C., or from about 50° C. to about 95° C., or from about 50° C. to about 93° C., or from about 60° C. to about 100° C., or from about 60° C. to about 98° C., or from about 60° C. to about 95° C., or from about 60° C. to about 93° C., or from about 70° C. to about 100° C., or from about 70° C. to about 98° C., or from about 70° C. to about 95° C., or from about 70° C. to about 93° C.

The term "interior surface" as it is applied to a cap or closure is any part of the closure interior that may come into contact with a hot liquid during a filling process.

An embodiment of the disclosure is a process to fill a container, the process comprising: adding a hot liquid to the container through a container opening, sealing the container opening with a closure comprising a high density polyethylene composition, and bringing the hot liquid into contact with an interior surface of the closure.

An embodiment of the present disclosure is a process to fill a container, the process comprising: adding a hot liquid to the container through a container opening, sealing the container opening with a closure comprising a unimodal polyethylene composition having a density from 0.945 to 0.967 g/cm$^3$, a melt index, $I_2$ of from 2.5 to 20.0 g/10 min, a weight average molecular weight (Mw) from 25,000 to 85,000 g/mol, and a molecular weight distribution $M_w/M_n$ of from 2.2 to 4.2; and bringing the hot liquid into contact with an interior surface of the closure.

Hot Fill Process

A hot fill process is often used in an automated container filling line. Use of the hot fill process is often the process of choice for juices, beverages and the like since it eliminates the need for the addition of chemicals and preservatives while maintaining the same shelf life and nutritional properties of the beverage. Consumers are often wary of the presence of preservatives and chemicals, and so hot filling processes provide a useful alternative.

The hot filling process can be used in combination with any suitable beverages, including vegetable and fruit juice, dairy products such as milk, flavored waters, sports drinks and the like.

A hot fill process comprises a series of steps. Ideally the steps are optimized to provide shorter container fill times while still providing acceptable beverage shelf life in the absence of added chemicals or preservatives. The steps are generally incorporated into a container or bottle fill line and generally comprise:

Step 1) A beverage is heated to the desired hot filling temperature. The temperatures employed are not specifically defined herein, but by way of non-limiting example only, can be from about 70° C. to about 95° C. Suitable temperatures include those which are known to kill microorganisms which may cause illness (e.g. temperatures at which the beverage or liquid is pasteurized). The beverage may be heated using any known device, such as but not limited to a heat exchanger, and may be heated in a continuous or batch manner. The beverage may be heated for any suitable time which is known to kill the microorganisms which may be present in the liquid. By way of a non-limiting examples, the beverage may be heated by passage through a heat exchanger for at least 10, or at least 15, or at least 20 seconds.

Step 2) A container is filled with the hot beverage using a suitable filling apparatus, followed by the addition of a closure. By hot filling the container, the container interior is sterilized by the hot beverage. Although the closure should be added immediately once the container is hot filled, nitrogen may be introduced into the head space to displace unwanted oxygen prior to the addition of the closure. Optionally, and before the container is filled with the hot beverage, the temperature of the liquid may be reduced slightly. By way of providing a non-limiting example only, the temperature of the beverage may be reduced to from about 80° C. to about less than 90° C.

Step 3) The container is tilted or inverted, or the bottle/closure system moved somehow, so as to bring the hot beverage into contact with the interior surface of the closure. Bringing the hot beverage into contact with the closure interior sterilizes the container interior surfaces.

Step 4) The sealed beverage container and closure may be cooled using a suitable cooling station or apparatus, such as but limited to a shower station or a cooling bath. In embodiments of the disclosure, the container-closure-beverage system is cooled to ambient temperatures or below. In order to preserve the beverage freshness and/or taste, in some embodiments, it may be preferable to rapidly cool the container-closure-beverage system. When cooling the sealed container, a vacuum may be created inside the container, further minimizing bacterial growth. Step 4 may also be considered as optional.

Other container fill line process steps known in the art may be used in combination with the above hot fill process steps. For example, the above hot fill process steps may be followed by further cooling, drying and labeling steps.

In an embodiment of the disclosure, the polymer compositions described below are used in the formation of molded articles. For example, articles formed by continuous compression molding and injection molding are contemplated. Such articles include, for example, caps, screw caps, and closures for bottles.

In an embodiment of the disclosure a closure is used in a hot fill process, wherein the closure comprises a unimodal polyethylene composition having a density from 0.945 to 0.967 g/cm$^3$, a melt index, $I_2$ of from 2.5 to 20.0 g/10 min, a weight average molecular weight (Mw) from 25,000 to 85,000 g/mol, and a molecular weight distribution $M_w/M_n$ of from 2.2 to 4.2.

Container (e.g. Bottle)

The material used for the container (or bottle and the like) is not specifically defined, but by way of providing a non-limiting example only, the material may be polyethylene terephthalate (PET). In another embodiment the container (e.g. bottle) may be made of glass. It should be understood that by use of the word "container" that any suitably shaped vessel, bottle, pouch and the like, may be used in the present invention, so long as they can store a liquid, and have a suitable aperture or structure which allows escape of the liquid and which can be sealed with a closure, cap or the like.

Closures

A closure as described in the present disclosure is a closure suitable for use in a container sealing process comprising one or more steps in which the closure comes into contact with a liquid at elevated temperatures, such as a hot fill processes, and in some cases aseptic fill processes.

In an embodiment of the disclosure a closure is used in a hot fill process, wherein the closure comprises a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

The terms "cap" and "closure" are used interchangeably in the current disclosure, and both connote any suitably shaped molded article for enclosing, sealing, closing or covering etc., a suitably shaped opening, a suitably molded aperture, an open necked structure or the like used in combination with a container, a bottle, a jar, a pouch and the like.

Without wishing to be bound by theory, the instantaneous compressive deformation of an "as-is" closure is a function of both instantaneous force (e.g. stress) and time in a non-linear relationship at a given temperature and modeling is required to elucidate the underlying structure-property relationships. The instantaneous compressive deformation model employed in the current disclosure is a compressive strain model represented by the following equation:

$$\varepsilon = A \times \sigma^n \times t^m$$

where ε is the compressive strain; σ is the stress in N/cm$^2$ and t is the loading time in seconds. A is the model coefficient; parameter n is termed the "deformation stress exponent" and m is termed the "time exponent". Any software capable of performing non-linear regressions can be used to estimate the model parameters. Such a compressive deformation model was recently disclosed at an ANTEC™ meeting as "Deformation Measurement, Modeling and Morphology Study for HDPE Caps and Closures", XiaoChuan (Alan) Wang, Mar. 23-25, 2015, Orlando, Fla., USA.

In an embodiment of the present disclosure, the closure has a time exponent, m of 0.114 or less where m is determined using a compressive strain model represented by the equation:

$$\varepsilon = A \times \sigma^n \times t^m$$

where ε is the compressive strain; σ is the stress in N/cm$^2$, t is the loading time in seconds, A is the model coefficient, n is the deformation stress exponent and m is the time exponent.

In further embodiments of the present disclosure, the closure has a time exponent, m of 0.111 or less, or ≤0.110, or ≤0.108, or ≤0.105, or ≤0.100, or ≤0.0950, or ≤0.0925, or ≤0.0925, or ≤0.0920, where m is determined using a compressive strain model represented by the equation:

$$\varepsilon = A \times \sigma^n \times t^m$$

where ε is the compressive strain; σ is the stress in N/cm$^2$, t is the loading time in seconds, A is the model coefficient, n is the deformation stress exponent and m is the time exponent.

In an embodiment of the present disclosure, the closure comprises a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

In an embodiment of the present disclosure, the closure comprises a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; a molecular weight distribution $M_w/M_n$ of from 2.2 to 4.2, and an ESCR Condition B (10% IGEPAL) of at least 1 hour.

In an embodiment of the present disclosure, the closure comprises a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; a molecular weight distribution $M_w/M_n$ of from 2.2 to 4.2, and an ESCR Condition B (10% IGEPAL) of from 1 to 10 hours.

In an embodiment of the disclosure, a high density polymer composition is used in the formation of any closure, of any suitable design and dimensions for use in any hot filling process for filling any suitable bottle, container or the like.

In an embodiment of the disclosure, the high density polyethylene compositions described below are used in the formation of a closure for bottles, containers, pouches and the like. For example, closures for bottles formed by continuous compression molding, or injection molding are contemplated. Such closures include, for example, hinged caps, hinged screw caps, hinged snap-top caps, and hinged closures for bottles, containers, pouches, stand-up pouches and the like.

In an embodiment of the disclosure, a closure (or cap) is a screw cap for a bottle, container, pouches and the like.

In an embodiment of the disclosure, a closure (or cap) is a snap closure for a bottle, container, pouches and the like.

In an embodiment of the disclosure, a closure (or cap) comprises a hinge made of the same material as the rest of the closure (or cap).

In an embodiment of the disclosure, a closure (or cap) is hinged closure.

In an embodiment of the disclosure, a closure (or cap) is a hinged closure for bottles, containers, pouches and the like.

In an embodiment of the disclosure, a closure (or cap) is a flip-top hinge closure, such as a flip-top hinge closure for use on a plastic ketchup bottle or similar containers containing foodstuffs.

When a closure is a hinged closure, it comprises a hinged component and generally consists of at least two bodies which are connected by a thinner section that acts as a hinge allowing the at least two bodies to bend from an initially molded position. The thinner section may be continuous or web-like, wide or narrow.

A useful closure (for bottles, containers and the like) is a hinged closure and may consist of two bodies joined to each other by at least one thinner bendable portion (e.g. the two bodies can be joined by a single bridging portion, or more than one bridging portion, or by a webbed portion, etc.). A first body may contain a dispensing hole and which may snap onto or screw onto a container to cover a container opening (e.g. a bottle opening) while a second body may serve as a snap on lid which may mate with the first body.

The caps and closures, of which hinged caps and closures and screw caps are a subset, can be made according to any known method, including for example injection molding and continuous compression molding techniques that are well known to persons skilled in the art. Hence, in an embodiment of the disclosure a closure (or cap) comprising the high density polyethylene composition (defined below) is prepared with a process comprising at least one compression molding step and/or at least one injection molding step.

In one embodiment, the closures (including single piece or multi-piece variants and hinged variants) are well suited for sealing bottles, containers and the like, for examples bottles that may contain drinkable water, and other foodstuffs, including but not limited to liquids that are under an appropriate pressure (i.e. carbonated beverages or appropriately pressurized drinkable liquids).

The closures and caps may also be used for sealing bottles containing drinkable water or non-carbonated beverages (e.g. juice). Other applications, include caps and closures for bottles, containers and pouches containing foodstuffs, such as for example ketchup bottles and the like.

The closures and caps may be one-piece closures or two piece closures comprising a closure and a liner.

The closures and caps may also be of multilayer design, wherein the closure or cap comprises at least two layers at least one of which is made of the high density polyethylene compositions described herein.

In an embodiment of the disclosure the closure is made by continuous compression molding.

In an embodiment of the disclosure the closure is made by injection molding.

Unimodal Polyethylene Compositions

In the present disclosure, the polyethylene compositions suitable for use in a filling process such as a hot fill process (or any other filling process which comprises at least one step carried out at elevated temperature, such as is the case in some aseptic fill processes) may be chosen based on their tendency to give closures having a combination of good resistance to cracking, sealability and good compressive deformation properties. Direct methods which measure the properties of the closure itself may provide a more accurate representation of the real word performance of a given polyethylene composition for various end use applications.

The term "unimodal" is herein defined to mean there will be only one significant peak or maximum evident in the GPC-curve. A unimodal profile includes a broad unimodal profile. Alternatively, the term "unimodal" connotes the presence of a single maxima in a molecular weight distribution curve generated according to the method of ASTM D6474-99. In contrast, by the term "bimodal" it is meant that there will be a secondary peak or shoulder evident in a GPC-curve which represents a higher or lower molecular weight component (i.e. the molecular weight distribution, can be said to have two maxima in a molecular weight distribution curve). Alternatively, the term "bimodal" connotes the presence of two maxima in a molecular weight distribution curve generated according to the method of ASTM D6474-99. The term "multi-modal" denotes the presence of two or more maxima in a molecular weight distribution curve generated according to the method of ASTM D6474-99.

In an embodiment of the present disclosure, the unimodal polyethylene composition has a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

In an embodiment of the present disclosure, the unimodal polyethylene composition has a density from 0.945 to 0.967 g/cm$^3$; a melt index, $I_2$ of from 2.5 to 20.0 g/10 min; a weight average molecular weight (Mw) from 25,000 to 85,000 g/mol; a molecular weight distribution $M_w/M_n$ of from 2.2 to 4.2, and an ESCR Condition B (10% IGEPAL) of at least 1 hour.

In an embodiment of the present disclosure, the unimodal polyethylene composition has a density from 0.945 to 0.967 g/cm$^3$; a melt index, $I_2$ of from 2.5 to 20.0 g/10 min; a weight average molecular weight (Mw) from 25,000 to 85,000 g/mol; a molecular weight distribution $M_w/M_n$ of from 2.2 to 4.2, and an ESCR Condition B (10% IGEPAL) of from 1 to 10 hours.

In an embodiment of the present disclosure, the unimodal polyethylene composition has a density from 0.945 to 0.967 g/cm$^3$.

In an embodiment of the disclosure, the unimodal polyethylene composition has a melt index, $I_2$ as determined according to ASTM D1238 (2.16 kg/190° C.) of from about 2.0 to about 25.0 g/10 min, or from about 2.5 to about 20.0 g/10 min, or from about 3.0 to about 20.0 g/10 min, or from about 2.0 to about 20.0 g/10 min. In other embodiments of the disclosure, the unimodal polyethylene composition has a melt index, $I_2$ as determined according to ASTM D1238 (2.16 kg/190° C.) of from about 4.0 to about 20.0, or from about 4.0 to about 18.0 g/10 min, or from about 3.0 to about 12.0 g/10 min, or from about 3.0 to about 10.0 g/10 min, or from about 7.0 to about 13.0 g/10 min, or from about 14.0 to about 21.0 g/10 min.

In an embodiment of the present disclosure, the unimodal polyethylene composition has a density from 0.945 to 0.967 g/cm$^3$.

In an embodiment of the disclosure, the unimodal polyethylene composition has a density of from about 0.945 to about 0.960 g/cm$^3$ as determined according to ASTM D 792. In other embodiments of the disclosure the unimodal polyethylene composition has a density of from about 0.948 to about 0.958 g/cm$^3$, or from about 0.949 g/cm$^3$ to about 0.955 g/cm$^3$.

In an embodiment of the disclosure, the unimodal polyethylene composition has a density from about 0.955 to about 0.967 g/cm$^3$ as determined according to ASTM D 792. In other embodiments of the disclosure the unimodal polyethylene composition has a density of from about 0.958 to about 0.965 g/cm$^3$, or from about 0.958 to about 0.963 g/cm$^3$, or from about 0.959 to 0.963 g/cm$^3$.

In an embodiment of the present disclosure, the unimodal polyethylene composition has an ESCR Condition B (10% IGEPAL) of at least 1 hour.

In an embodiment of the present disclosure, the unimodal polyethylene composition has an ESCR Condition B (10% IGEPAL) of from 1 to 10 hours.

In an embodiment of the disclosure, the unimodal polyethylene composition has a weight average molecular weight (Mw) from about 20,000 to about 100,000. In other embodiments of the disclosure the unimodal polyethylene composition has a weight average molecular weight (Mw) from about 25,000, to about 85,000, or from about 30,000 to about 85,000, or from about 35,000 to about 80,000, or from about 40,000 to about 80,000, or from about 40,000 to about 75,000.

In an embodiment of the disclosure, the unimodal polyethylene composition has a molecular weight distribution ($M_W/M_N$) of from about 2.2 to about 4.2. In other embodiments of the disclosure, the unimodal polyethylene copolymer has a molecular weight distribution ($M_W/M_N$) of from about 2.5 to about 4.0, or about 2.5 to about 3.5, or from about 2.5 to about 3.0, or from about from about 2.7 to about 3.5, or from about 2.7 to about 3.0.

In an embodiment of the disclosure, the unimodal polyethylene composition has a stress exponent, defined as $Log_{10}[I_6/I_2]/Log_{10}[6.48/2.16]$, which is ≤1.45. In further embodiments of the disclosure the polyethylene composition has a stress exponent, $Log_{10}[I_6/I_2]/Log_{10}[6.48/2.16]$ of less than 1.40, or less than 1.37, or less than 1.35.

In an embodiment of the present disclosure, the unimodal polyethylene composition is a unimodal ethylene homopolymer.

As used herein, the term "homopolymer" is meant to convey its conventional meaning, that the polymer is prepared using only ethylene as a polymerizable monomer (although it will be recognized by those skilled in the art that very minor amounts, less than 1%, of higher alpha olefins may be present in a conventional "homopolymer" as a result of contamination of the ethylene stream and/or the polymerization medium).

In an embodiment of the present disclosure, the unimodal polyethylene composition is a unimodal ethylene copolymer.

In an embodiment of the disclosure the unimodal polyethylene composition is a copolymer of ethylene and an alpha olefin.

Suitable comonomers for polymerization with ethylene to make a unimodal ethylene copolymer include 1-butene, 1-hexene and 1-octene.

Examples of unimodal polyethylene homopolymers which are useful in the present disclosure are SCLAIR® 2908 and SCLAIR® 2907 which are commercially available from NOVA Chemicals Corporation. Examples of unimodal polyethylene copolymers which are useful in the present disclosure are SCLAIR® 2710 and SCLAIR®2807 which are commercially available from NOVA Chemicals Corporation.

In an embodiment of the disclosure the unimodal polyethylene copolymer comprises from about 0.1 to about 5 weight %, in some cases less than about 3 weight %, in other instances less than about 1.5 weight % of an alpha olefin selected from of 1-butene, 1-hexene, 1-octene and mixtures thereof.

In an embodiment of the disclosure, the unimodal polyethylene copolymer comprises 1-butene.

In an embodiment of the disclosure, the unimodal polyethylene copolymer has a density of from about 0.945 to about 0.960 g/cm$^3$ as determined according to ASTM D 792. In other embodiments of the disclosure the unimodal polyethylene copolymer has a density of from about 0.948 to about 0.958 g/cm$^3$, or from about 0.949 g/cm$^3$ to about 0.955 g/cm$^3$.

In an embodiment of the disclosure, the unimodal polyethylene copolymer has a melt index, $I_2$ as determined according to ASTM D1238 (2.16 kg/190° C.) from about 2.0 to about 25.0 g/10 min, or from about 2.5 to about 20.0 g/10 min, or from about 3.0 to about 20.0 g/10 min, or from about 2.0 to about 20.0 g/10 min. In other embodiments of the disclosure, the unimodal polyethylene copolymer has a melt index, $I_2$ as determined according to ASTM D1238 (2.16 kg/190° C.) of from about 4.0 to about 20.0, or from about 4.0 to about 18.0 g/10 min, or from about 3.0 to about 10.0 g/10 min, or from about 7.0 to about 13.0 g/10 min, or from about 14.0 to about 21.0 g/10 min.

In an embodiment of the disclosure, the unimodal polyethylene copolymer has a weight average molecular weight (Mw) from about 20,000 to about 100,000. In other embodiments of the disclosure the unimodal polyethylene copolymer has a weight average molecular weight (Mw) from about 25,000, to about 85,000, or from about 30,000 to about 85,000, or from about 35,000 to about 80,000, or from about 40,000 to about 80,000, or from about 40,000 to about 75,000.

In embodiments of the disclosure, the unimodal polyethylene copolymer has a molecular weight distribution ($M_W/M_N$) of from about 2.2 to about 4.2, or from about 2.5 to about 4.0. In other embodiments of the disclosure, the unimodal polyethylene copolymer has a molecular weight distribution ($M_W/M_N$) of from about 2.5 to about 3.5, or from about 2.5 to about 3.0, or from about from about 2.7 to about 3.5, or from about 2.7 to about 3.0.

Examples of unimodal polyethylene copolymers which are useful in the present disclosure include by way of non-limiting example, SCLAIR® 2710, and SCLAIR® 2807, each of which is commercially available from NOVA Chemicals Corporation.

In an embodiment of the disclosure, the unimodal polyethylene homopolymer has a density from about 0.955 to about 0.967 g/cm$^3$ as determined according to ASTM D 792. In other embodiments of the disclosure the unimodal polyethylene homopolymer has a density of from about 0.958 to about 0.965 g/cm$^3$, or from about 0.958 to about 0.963 g/cm$^3$, or from about 0.959 to 0.963 g/cm$^3$.

In an embodiment of the disclosure, the unimodal polyethylene homopolymer has a melt index, $I_2$ as determined according to ASTM D1238 (2.16 kg/190° C.) of from about 2.0 to about 25.0 g/10 min, or from about 2.5 to about 20.0 g/10 min, or from about 3.0 to about 20.0 g/10 min, or from about 2.0 to about 20.0 g/10 min. In other embodiments of the disclosure, the unimodal polyethylene homopolymer has a melt index, $I_2$ as determined according to ASTM D1238 (2.16 kg/190° C.) of from about 4.0 to about 18.0 g/10 min, or from about 3.0 to about 12.0 g/10 min, or from about 3.0 to about 10.0 g/10 min, or from about 7.0 to about 13.0 g/10 min, or from about 14.0 to about 21.0 g/10 min.

In an embodiment of the disclosure, the unimodal polyethylene homopolymer has a weight average molecular weight (Mw) from about 20,000 to about 100,000. In other embodiments of the disclosure the unimodal polyethylene homopolymer has a weight average molecular weight (Mw) from about 25,000, to about 85,000, or from about 30,000 to about 85,000, or from about 35,000 to about 80,000, or from about 40,000 to about 80,000, or from about 40,000 to about 75,000.

In an embodiment of the disclosure, the unimodal polyethylene homopolymer has a molecular weight distribution ($M_W/M_N$) of from about 2.2 to about 4.2. In other embodiments of the disclosure, the unimodal polyethylene homopolymer has a molecular weight distribution ($M_W/M_N$) of from about 2.5 to about 4.0, or from about 2.5 to about 3.5, or from about 2.5 to about 3.25.

Examples of unimodal polyethylene homopolymers which are useful in the present disclosure include by way of non-limiting example, SCLAIR® 2907, and SCLAIR®2908, each of which is commercially available from NOVA Chemicals Corporation.

In an embodiment of the disclosure, the unimodal polyethylene copolymers or homopolymers suitable for use in the present disclosure may be prepared using conventional polymerization processes, non-limiting examples of which include gas phase, slurry and solution phase polymerization processes. Such processes are well known to those skilled in the art.

In an embodiment of the disclosure, the polyethylenes may be prepared using conventional catalysts. Some non-limiting examples of conventional catalysts include chrome based catalysts and Ziegler-Natta catalysts. Such catalysts are well known to those skilled in the art.

Solution and slurry polymerization processes are generally conducted in the presence of an inert hydrocarbon solvent/diluent, such for example, a $C_{4-12}$ hydrocarbon which may be unsubstituted or substituted by a $C_{1-4}$ alkyl group, such as, butane, pentane, hexane, heptane, octane, cyclohexane, methylcyclohexane or hydrogenated naphtha. A non-limiting example of a commercial solvent is Isopar E ($C_{8-12}$ aliphatic solvent, Exxon Chemical Co.). The monomers are dissolved in the solvent/diluent.

A slurry polymerization process may be conducted at temperatures from about 20° C. to about 180° C., or from 80° C. to about 150° C., and the polyethylene polymer being made is insoluble in the liquid hydrocarbon diluent.

A solution polymerization process may be conducted at temperatures of from about 180° C. to about 250° C., or from about 180° C. to about 230° C., and the polyethylene polymer being made is soluble in the liquid hydrocarbon phase (e.g the solvent).

A gas phase polymerization process can be carried out in either a fluidized bed or a stirred bed reactor. A gas phase polymerization typically involves a gaseous mixture comprising from about 0 to about 15 mole % of hydrogen, from about 0 to about 30 mole % of one or more $C_{3-8}$ alpha-olefins, from about 15 to about 100 mole % of ethylene, and from about 0 to about 75 mole % of an inert gas at a temperature from about 50° C. to about 120° C., or from about 75° C. to about 110° C.

Suitable alpha olefins which may be polymerized with ethylene in the case of a polyethylene copolymer are $C_3$-8 alpha olefins such as one or more of 1-butene, 1-hexene, and 1-octene.

In an embodiment of the disclosure the unimodal polyethylene composition is prepared by contacting ethylene and optionally an alpha-olefin with a polymerization catalyst under solution polymerization conditions.

In an embodiment of the disclosure the unimodal polyethylene composition is made with a Ziegler-Natta catalyst.

In an embodiment of the disclosure, the unimodal polyethylene copolymer or homopolymer are made in a solution polymerization process using a Ziegler-Natta catalyst.

The term "Ziegler-Natta" catalyst is well known to those skilled in the art and is used herein to convey its conventional meaning. Ziegler-Natta catalysts comprise at least one transition metal compound of a transition metal selected from groups 3, 4, or 5 of the Periodic Table (using IUPAC nomenclature) and an organoaluminum component that is defined by the formula:

$$Al(X')_a(OR)_b(R)_c$$

wherein: X' is a halide (for example, chlorine); OR is an alkoxy or aryloxy group; R is a hydrocarbyl (for example, an alkyl having from 1 to 10 carbon atoms); and a, b, or c are each 0, 1, 2, or 3 with the provisos, $a+b+c=3$ and $b+c\geq 1$. As will be appreciated by those skilled in the art of ethylene polymerization, conventional Ziegler Natta catalysts may also incorporate additional components such as an electron donor. For example, an amine or a magnesium compound or a magnesium alkyl such as butyl ethyl magnesium and a halide source (which may be, for example, a chloride such as tertiary butyl chloride).

Such components, if employed, may be added to the other catalyst components prior to introduction to the reactor or may be added directly to the reactor. The Ziegler-Natta catalyst may also be "tempered" (i.e. heat treated) prior to being introduced to the reactor (again, using techniques which are well known to those skilled in the art and published in the literature).

In an embodiment of the disclosure, the unimodal polyethylene composition has less than 1.5 ppm, or less than 1.3 ppm, or ≤1.0 ppm, or ≤0.9 ppm, or ≤0.8, or less than 0.8 ppm, or ≤0.75 ppm of titanium (Ti) present.

In an embodiment of the disclosure, the unimodal polyethylene composition has less than 1.5 ppm, or less than 1.3 ppm, or ≤1.0 ppm, or ≤0.9 ppm, or ≤0.8 ppm, or ≤0.75, or ≤0.60 ppm of aluminum (Al) present.

In an embodiment of the disclosure, the unimodal polyethylene composition has less than 0.5 ppm, or less than 0.4 ppm, or ≤0.3 ppm, or ≤0.2 ppm of chlorine (Cl) present.

In an embodiment of the disclosure, the unimodal polyethylene composition has less than 4.0 ppm, or less than 3.0 ppm, or ≤2.5 ppm, or ≤2.0 ppm, of magnesium (Mg) present.

In an embodiment of the disclosure the unimodal polyethylene composition comprises one or more nucleating agents.

In an embodiment of the disclosure the unimodal polyethylene composition comprises a nucleating agent or a mixture of nucleating agents.

The unimodal polyethylene composition may be compounded or dry-blended either by a manufacturer or a converter (e.g., the company converting the resin pellets into the final product). The compounded or dry-blended polyethylene polymers may contain fillers, pigments and other additives. In some embodiments fillers are inert additives, such as, clay, talc, $TiO_2$ and calcium carbonate, which may be added to the polyolefin in amounts from about 0 weight % up to about 50 weight %, in some cases, less than 30 weight % of fillers are added. The compounded or dry-blended polyethylene polymers may contain antioxidants, heat and light stabilizers, such as, combinations of one or more of hindered phenols, phosphates, phosphites and phosphonites, in some embodiments, in amounts of less than about 0.5 weight % based on the weight of the polyethylene polymer. Pigments may also be added to the polyethylene polymers in small amounts. Non-limiting examples of pigments include carbon black, phthalocyanine blue, Congo red, titanium yellow, etc.

The unimodal polyethylene compositions may contain a nucleating agent or a mixture of nucleating agents in amounts of from about 5 parts per million (ppm) to about 10,000 ppm based on the weight of the polyethylene polymer. The nucleating agent may be selected from dibenzylidene sorbitol, di(p-methyl benzylidene) sorbitol, di(o-methyl benzylidene) sorbitol, di(p-ethylbenzylidene) sorbitol, bis(3,4-dimethyl benzylidene) sorbitol, bis(3,4-diethylbenzylidene) sorbitol and bis(trimethyl-benzylidene)

sorbitol. One commercially available nucleating agent is bis(3,4-dimethyl benzylidene) sorbitol.

Optionally, additives can be added to the high density polyethylene composition. Additives can be added to the high density polyethylene composition during an extrusion or compounding step, but other suitable known methods will be apparent to a person skilled in the art. The additives can be added as is or as part of a separate polymer component (i.e., not the first or second ethylene polymers described above) added during an extrusion or compounding step. Suitable additives are known in the art and include but are not-limited to antioxidants, phosphites and phosphonites, nitrones, antacids, UV light stabilizers, UV absorbers, metal deactivators, dyes, fillers and reinforcing agents, nano-scale organic or inorganic materials, antistatic agents, lubricating agents such as calcium stearates, slip additives such as erucimide, and nucleating agents (including nucleators, pigments or any other chemicals which may provide a nucleating effect to the high density polyethylene composition). The additives that can be optionally added are may be added in amounts of, for example, up to 20 weight percent (wt %).

One or more nucleating agent(s) may be introduced into the unimodal polyethylene composition by kneading a mixture of the polymer, usually in powder or pellet form, with the nucleating agent, which may be utilized alone or in the form of a concentrate containing further additives such as stabilizers, pigments, antistatics, UV stabilizers and fillers. It should be a material which is wetted or absorbed by the polymer, which is insoluble in the polymer and of melting point higher than that of the polymer, and it should be homogeneously dispersible in the polymer melt in as fine a form as possible (1 to 10 μm). Compounds known to have a nucleating capacity for polyolefins include salts of aliphatic monobasic or dibasic acids or arylalkyl acids, such as sodium succinate, or aluminum phenylacetate; and alkali metal or aluminum salts of aromatic or alicyclic carboxylic acids such as sodium β-naphthoate, or sodium benzoate.

Examples of nucleating agents which are commercially available and which may be added to the high density polyethylene composition are dibenzylidene sorbital esters (such as the products sold under the trademark Millad 3988™ by Milliken Chemical and Irgaclear™ by Ciba Specialty Chemicals). Further examples of nucleating agents which may added to the high density polyethylene composition include the cyclic organic structures disclosed in U.S. Pat. No. 5,981,636 (and salts thereof, such as disodium bicyclo [2.2.1]heptene dicarboxylate); the saturated versions of the structures disclosed in U.S. Pat. No. 5,981,636 (as disclosed in U.S. Pat. No. 6,465,551; Zhao et al., to Milliken); the salts of certain cyclic dicarboxylic acids having a hexahydrophtalic acid structure (or "HHPA" structure) as disclosed in U.S. Pat. No. 6,599,971 (Dotson et al., to Milliken); and phosphate esters, such as those disclosed in U.S. Pat. No. 5,342,868 and those sold under the trade names NA-11 and NA-21 by Asahi Denka Kogyo, cyclic dicarboxylates and the salts thereof, such as the divalent metal or metalloid salts, (particularly, calcium salts) of the HHPA structures disclosed in U.S. Pat. No. 6,599,971. For clarity, the HHPA structure generally comprises a ring structure with six carbon atoms in the ring and two carboxylic acid groups which are substituents on adjacent atoms of the ring structure. The other four carbon atoms in the ring may be substituted, as disclosed in U.S. Pat. No. 6,599,971. An example is 1,2-cyclohexanedicarboxylicacid, calcium salt (CAS registry number 491589-22-1). Still further examples of nucleating agents which may added to the polyethylene composition include those disclosed in WO2015042561, WO2015042563, WO2015042562 and WO 2011050042.

Many of the above described nucleating agents may be difficult to mix with the unimodal polyethylene composition that is being nucleated and it is known to use dispersion aids, such as, for example, zinc stearate, to mitigate this problem.

In an embodiment of the disclosure, the nucleating agents are well dispersed in the unimodal polyethylene composition.

In an embodiment of the disclosure, the amount of nucleating agent used is comparatively small—from 5 to 3000 parts by million per weight (based on the weight of the polyethylene composition) so it will be appreciated by those skilled in the art that some care must be taken to ensure that the nucleating agent is well dispersed. In an embodiment of the disclosure, the nucleating agent is added in finely divided form (less than 50 microns, especially less than 10 microns) to the polyethylene composition to facilitate mixing. This type of "physical blend" (i.e., a mixture of the nucleating agent and the resin in solid form) generally uses a "masterbatch" of the nucleator (where the term "masterbatch" refers to the practice of first melt mixing the additive—the nucleator, in this case—with a small amount of the unimodal polyethylene composition resin—then melt mixing the "masterbatch" with the remaining bulk of the unimodal polyethylene composition resin).

In an embodiment of the disclosure, an additive such as nucleating agent may be added to the unimodal polyethylene composition by way of a "masterbatch", where the term "masterbatch" refers to the practice of first melt mixing the additive (e.g., a nucleator) with a small amount of the polyethylene composition, followed by melt mixing the "masterbatch" with the remaining bulk of the unimodal polyethylene composition.

In an embodiment of the disclosure, the unimodal polyethylene composition further comprises a nucleating agent or a mixture of nucleating agents.

In embodiments where the unimodal polyethylene copolymer or homopolymer is used in closures used for food contact applications, the additive package must meet the appropriate food regulations, such as, the FDA regulations in the United States.

In an embodiment of the disclosure, the unimodal polyethylene compositions described above are used in the formation of molded articles. For example, articles formed by continuous compression molding and injection molding are contemplated. Such articles include, for example, caps, screw caps, and closures for bottles.

In an embodiment of the disclosure, the closure made is a PCO 1881 CSD closure, having a weight of about 2.15 grams and having the following dimensions: Closure height (not including Tamper Ring)=about 10.7 mm; Closure height with Tamper Ring=about 15.4 mm; Outside diameter @ 4 mm=about 29.6 mm; Thread diameter=about 25.5 mm; Bump seal diameter=about 24.5 mm; Bump seal thickness=about 0.7 mm; Bump seal height to center of olive=about 1.5 mm; Bore seal diameter=about 22.5 mm; Bore seal thickness=about 0.9 mm; Bore height to center of olive=about 1.6 mm; Top panel thickness=about 1.2 mm; Tamper band undercut diameter=about 26.3 mm; Thread depth=about 1.1 mm; Thread pitch=about 2.5 mm; Thread Root @ 4 mm=27.4 mm.

In an embodiment of the disclosure, the closure is made using an injection molding process to prepare a PCO 1881 CSD closure, having a weight of about 2.15 grams and having the following dimensions: Closure height (not including Tamper Ring)=about 10.7 mm; Closure height with Tamper Ring=about 15.4 mm; Outside diameter @ 4 mm=about 29.6 mm; Thread diameter=about 25.5 mm; Bump seal diameter=about 24.5 mm; Bump seal thickness=about 0.7 mm; Bump seal height to center of olive=about 1.5 mm; Bore seal diameter=about 22.5 mm; Bore seal thickness=about 0.9 mm; Bore height to center of olive=about 1.6 mm; Top panel thickness=about 1.2 mm; Tamper band undercut diameter=about 26.3 mm; Thread depth=about 1.1 mm; Thread pitch=about 2.5 mm; Thread Root @ 4 mm=27.4 mm.

In an embodiment of the disclosure, the closure is made using a continuous compression molding process to prepare a PCO 1881 CSD closure, having a weight of about 2.15 grams and having the following dimensions: Closure height (not including Tamper Ring)=about 10.7 mm; Closure height with Tamper Ring=about 15.4 mm; Outside diameter @ 4 mm=about 29.6 mm; Thread diameter=about 25.5 mm; Bump seal diameter=about 24.5 mm; Bump seal thickness=about 0.7 mm; Bump seal height to center of olive=about 1.5 mm; Bore seal diameter=about 22.5 mm; Bore seal thickness=about 0.9 mm; Bore height to center of olive=about 1.6 mm; Top panel thickness=about 1.2 mm; Tamper band undercut diameter=about 26.3 mm; Thread depth=about 1.1 mm; Thread pitch=about 2.5 mm; Thread Root @ 4 mm=27.4 mm.

The disclosure is further illustrated by the following non-limiting examples.

EXAMPLES

General Polymer Characterization Methods $M_n$, $M_w$, and $M_z$ (g/mol) were determined by high temperature Gel Permeation Chromatography (GPC) with differential refractive index (DRI) detection using universal calibration (e.g. ASTM-D6474-99). GPC data was obtained using an instrument sold under the trade name "Waters 150c", with 1,2,4-trichlorobenzene as the mobile phase at 140° C. The samples were prepared by dissolving the polymer in this solvent and were run without filtration. Molecular weights are expressed as polyethylene equivalents with a relative standard deviation of 2.9% for the number average molecular weight ("Mn") and 5.0% for the weight average molecular weight ("Mw"). The molecular weight distribution (MWD) is the weight average molecular weight divided by the number average molecular weight, $M_w/M_n$. The z-average molecular weight distribution is $M_z/M_n$. Polymer sample solutions (1 to 2 mg/mL) were prepared by heating the polymer in 1,2,4-trichlorobenzene (TCB) and rotating on a wheel for 4 hours at 150° C. in an oven. The antioxidant 2,6-di-tert-butyl-4-methylphenol (BHT) was added to the mixture in order to stabilize the polymer against oxidative degradation. The BHT concentration was 250 ppm. Sample solutions were chromatographed at 140° C. on a PL 220 high-temperature chromatography unit equipped with four Shodex columns (HT803, HT804, HT805 and HT806) using TCB as the mobile phase with a flow rate of 1.0 mL/minute, with a differential refractive index (DRI) as the concentration detector. BHT was added to the mobile phase at a concentration of 250 ppm to protect the columns from oxidative degradation. The sample injection volume was 200 mL. The raw data were processed with Cirrus GPC software. The columns were calibrated with narrow distribution polystyrene standards. The polystyrene molecular weights were converted to polyethylene molecular weights using the Mark-Houwink equation, as described in the ASTM standard test method D6474.

Primary melting peak (° C.), heat of fusion (J/g) and crystallinity (%) was determined using differential scanning calorimetry (DSC) as follows: the instrument was first calibrated with indium; after the calibration, a polymer specimen is equilibrated at 0° C. and then the temperature was increased to 200° C. at a heating rate of 10° C./min; the melt was then kept isothermally at 200° C. for five minutes; the melt was then cooled to 00° C. at a cooling rate of 10° C./min and kept at 0° C. for five minutes; the specimen was then heated to 200° C. at a heating rate of 10° C./min. The DSC Tm, heat of fusion and crystallinity are reported from the $2^{nd}$ heating cycle.

The short chain branch frequency (SCB per 1000 carbon atoms) of copolymer samples was determined by Fourier Transform Infrared Spectroscopy (FTIR) as per the ASTM D6645-01 method. A Thermo-Nicolet 750 Magna-IR Spectrophotometer equipped with OMNIC version 7.2a software was used for the measurements.

Comonomer content can also be measured using $^{13}C$ NMR techniques as discussed in Randall, Rev. Macromol. Chem. Phys., $C_{29}$ (2&3), p 285; U.S. Pat. No. 5,292,845 and WO 2005/121239.

Polyethylene composition density (g/cm$^3$) was measured according to ASTM D792.

Hexane extractables were determined according to ASTM D5227.

Melt indexes, $I_2$, $I_6$ and $I_{21}$ for the polyethylene composition were measured according to ASTM D1238 (when conducted at 190° C., using a 2.16 kg, a 6.48 kg and a 21 kg weight respectively).

To determine $CDBI_{50}$, a solubility distribution curve is first generated for the polyethylene composition. This is accomplished using data acquired from the TREF technique. This solubility distribution curve is a plot of the weight fraction of the copolymer that is solubilized as a function of temperature. This is converted to a cumulative distribution curve of weight fraction versus comonomer content, from which the $CDBI_{50}$ is determined by establishing the weight percentage of a copolymer sample that has a comonomer content within 50% of the median comonomer content on each side of the median (See WO 93/03093 and U.S. Pat. No. 5,376,439). The $CDBI_{25}$ is determined by establishing the weight percentage of a copolymer sample that has a comonomer content within 25% of the median comonomer content on each side of the median.

The specific temperature rising elution fractionation (TREF) method used herein was as follows. Polymer samples (50 to 150 mg) were introduced into the reactor vessel of a crystallization-TREF unit (Polymer ChAR™). The reactor vessel was filled with 20 to 40 ml 1,2,4-trichlorobenzene (TCB), and heated to the desired dissolution temperature (e.g., 150° C.) for 1 to 3 hours. The solution (0.5 to 1.5 ml) was then loaded into the TREF column filled with stainless steel beads. After equilibration at a given stabilization temperature (e.g., 110° C.) for 30 to 45 minutes, the polymer solution was allowed to crystallize with a temperature drop from the stabilization temperature to 30° C. (0.1 or 0.2° C./minute). After equilibrating at 30° C. for 30 minutes, the crystallized sample was eluted with TCB (0.5 or 0.75 mL/minute) with a temperature ramp from 30° C. to the stabilization temperature (0.25 or 1.0° C./minute). The TREF column was cleaned at the end of the run for 30 minutes at the dissolution temperature. The data were processed using Polymer ChAR software, Excel spreadsheet and TREF software developed in-house.

Plaques molded from the polyethylene compositions were tested according to the following ASTM methods: Bent Strip Environmental Stress Crack Resistance (ESCR) at Condition B at 10% IGEPAL at 50° C., ASTM D1693; notched Izod impact properties, ASTM D256; Flexural Properties, ASTM D 790; Vicat softening point, ASTM D 1525; Heat deflection temperature, ASTM D 648.

Closures

Generally, the mechanically sealing surfaces between a polyethylene closure and PET bottle neck finish have very complex geometries. As such it is difficult to perform a systematic study using general experimental methods. For example, numerical simulations (e.g. Finite Element Analysis) may be useful for this purpose, but the inputs of the material properties for this type of analysis generally use those from compression-molded plaques made in a laboratory environment. Compression molded plaques however, may have very different material morphologies and properties than those of a closure manufactured with industrial injection molding or continuous compression molding processes. A methodology which can be used to obtain closure strain model parameters on closures that have been made according to commercial practices provides an alternative. One such methodology, also used in the present disclosure, was recently disclosed at an ANTEC™ meeting as *"Deformation Measurement, Modeling and Morphology Study for HDPE Caps and Closures"*, XiaoChuan (Alan) Wang, March 23-25, 2015, Orlando, Fla., USA.

The methodology used in the present disclosure is to use the deformation (e.g. creep) of the top panel of an as-is closure to approximate that between the mechanically sealing surfaces of the plastic closure and PET bottle neck finish after a closure is put or screwed onto a PET bottle (see FIGS. 1-5 in *"Deformation Measurement, Modeling and Morphology Study for HDPE Caps and Closures"*, XiaoChuan (Alan) Wang, March 23-25, 2015, Orlando, Fla., USA, ANTEC meeting). The use of a closure, instead of a standardized plaque, reflects the true molded material morphology and includes the contribution of the closure design. The deformation of the top panel of the closure can be well defined for the purpose of comparing closures made from different materials. By examining the top panel of the closure, one avoids dealing with the complex geometries of the sealing surfaces.

The following measurements and modeling can be used for any "as-is" closure design, provided that the closures being compared are prepared using substantially the same method under substantially similar conditions to provide closures having substantially similar design and dimensions. By way of non-limiting example only, the following method of preparing closures, closures which can then be compared using the methods described herein, is provided.

Method of Making a Closure by Injection Molding

A Sumitomo injection molding machine and 2.15-gram PCO (plastic closure only) 1881 carbonated soft drink (CSD) closure mold was used to prepare the closures herein. A Sumitomo injection molding machine (model SE75EV C250M) having a 28 mm screw diameter was used. The 4-cavity CSD closure mold was manufactured by Z-moulds (Austria). The 2.15-gram PCO 1881 CSD closure design was developed by Universal Closures Ltd. (United Kingdom). During the closure manufacturing, four closure parameters, the diameter of the top of the cap, the bore seal diameter, the tamper band diameter and the overall cap height, were measured and ensured to be within quality-control specifications.

For red pigmented closures, resins are dry-blended with 2% slip (erucamide) master batch (Ampacet slip 101797 with the 5 wt % slip; 1000 ppm slip additive in the final resin) and 1% of red masterbatch (Ampacet PE red masterbatch LJ-206971 with 1.5 wt. % red pigment; 150 ppm red pigment in the final resin) prior to injection molding.

An International Society of Beverage Technologists (ISBT) voluntary standard test method was used to determine the closure dimensions. The test used involves the selection of a mold cavity and the measurements on at least 5 closures made from that particular cavity. At least 14 dimensional measurements were obtained from closures that were aged for at least 1 week from the date of production. The closure dimension measurements was performed using a Vision Engineering, Swift Duo dual optical and video measuring system. All measurements were taken using 10× magnification and utilizing Metlogix M video measuring system software (see MetLogix $M^3$: Digital Comparator Field of View Software, User's Guide).

Example 1 (Comparative) is a closure made from a unimodal polyethylene copolymer having a melt index $I_2$ of 32 g/10 min, a density of 0.951 g/cm$^3$, and a weight average molecular weight Mw/Mn of 2.88, and which is made using a Ziegler-Natta catalyst in a solution olefin polymerization process. This resin is commercially available from NOVA Chemicals Corporation as SCLAIR® 2712. A GPC profile for the resin is given in FIG. 1A.

Example 2 is a closure made from a unimodal polyethylene copolymer and has a melt index $I_2$ of 17 g/10 min, a density of 0.951 g/cm$^3$, and a weight average molecular weight Mw/Mn of 2.72. The unimodal polyethylene copolymer used in Example 2, was made using a Ziegler-Natta catalyst in a solution olefin polymerization process. This resin is commercially available from NOVA Chemicals Corporation as SCLAIR 2710. A GPC profile for the resin is given in FIG. 1B.

Example 3 is a closure made from a unimodal polyethylene copolymer and has a melt index $I_2$ of 6.7 g/10 min, a density of 0.954 g/cm$^3$, and a weight average molecular weight Mw/Mn of 2.72. The unimodal polyethylene copolymer used in Example 3, was made using a Ziegler-Natta catalyst in a solution olefin polymerization process. This resin is commercially available from NOVA Chemicals Corporation as SCLAIR 2807. A GPC profile for the resin is given in FIG. 1C.

Example 4 is a closure made from a unimodal polyethylene homopolymer and has a melt index $I_2$ of 10 g/10 min, a density of 0.961 g/cm$^3$, and a weight average molecular weight Mw/Mn of 2.99. The unimodal polyethylene homopolymer used in Example 4, was made using a Ziegler-Natta catalyst in a solution olefin polymerization process. This resin is commercially available from NOVA Chemicals Corporation as SCLAIR 2908. A GPC profile for the resin is given in FIG. 1D.

Example 5 is a closure made from a unimodal polyethylene homopolymer and has a melt index $I_2$ of 5 g/10 min, a density of 0.960 g/cm$^3$, and a weight average molecular weight Mw/Mn of 2.67. The unimodal polyethylene homopolymer used in Example 5, was made using a Ziegler-Natta catalyst in a solution olefin polymerization process. This resin is commercially available from NOVA Chemicals Corporation as SCLAIR 2907. A GPC profile for the resin is given in FIG. 1E.

The polymers used to make closures in Examples 1-5 are shown in Table 1, along with their plaque data. The closures were formed by injection molding, and the injection-molding processing conditions are given in Table 2. Closure dimensions are provided in Table 3.

A person skilled in the art will recognize that, if analogous closures are made using continuous compression molding (instead of injection molding), the present methodology, models and model parameters would be expected to generate similar data, provided one uses an analogous mold.

TABLE 1

Polymer Properties and Plaque Data.

| | Example | | | | |
|---|---|---|---|---|---|
| | 1, Comparative | 2 | 3 | 4 | 5 |
| **Polymer** | | | | | |
| Modality | Unimodal | Unimodal | Unimodal | Unimodal | Unimodal |
| Alpha Olefin Comonomer | 1-butene | 1-butene | 1-butene | None | none |
| $I_2$, g/10 min | 32 | 17 | 6.7 | 10 | 5 |
| Density, g/cm$^3$ (Resin) | 0.951 | 0.951 | 0.954 | 0.961 | 0.960 |
| $I_{21}/I_2$ | 22.7 | 24 | 28.2 | 25.7 | 27 |
| Stress Exponent | 1.24 | 1.27 | 1.33 | 1.29 | 1.32 |
| Mn (g/mol) | 14928 | 19622 | 26005 | 21120 | 27405 |
| Mw (g/mol) | 43003 | 53372 | 70836 | 63069 | 73262 |
| Mz (g/mol) | 95318 | 123854 | 185530 | 172700 | 183608 |
| Mw/Mn | 2.88 | 2.72 | 2.72 | 2.99 | 2.67 |
| $CDBI_{50}$ (%) | 68.7 | 72.8 | 78.8 | | |
| $CDBI_{25}$ (%) | 50.5 | 59.6 | 66.9 | | |
| DSC | | | | | |
| Primary Melting Peak (° C.) | 126.99 | 127.75 | 130.04 | 131.92 | 132.13 |
| Heat of Fusion (J/g) | 210.4 | 205.4 | 215.7 | 228.7 | 226.3 |
| Crystallinity (%) | 72.55 | 70.82 | 74.37 | 78.87 | 78.05 |
| FTIR | | | | | |
| Short chain branching per 1000 carbons (uncorrected for chain end —$CH_3$) | 1.3 | 0.7 | <0.5 | | |
| Internal unsaturation (No. per 100 carbons) | 0.008 | 0.006 | 0.004 | 0.003 | 0.003 |
| Side chain unsaturation (No. per 100 carbons) | 0.005 | 0.005 | 0.003 | 0.003 | 0.003 |
| Terminal unsaturation (No. per 100 carbons) | 0.085 | 0.079 | 0.072 | 0.071 | 0.072 |
| **Plaque** | | | | | |
| 2% Secant Flexural Modulus (MPa) | 786 | 787 | 886 | 1080 | 1018 |
| ESCR Cond. B at 10% (hrs) | 0 | 1 | 3 | NA | 4 |
| Heat Deflection Temp at 66 PSI (° C.) | 66 | 65.4 | 74 | 77.3 | 75 |
| VICAT Softening Point (° C.) | 122 | 123.9 | 127 | 128.3 | 129 |
| Notched Izod Impact Strength (ft-lb/in) | 0.66 | 0.76 | 1.13 | NA | NA |
| Hexane extractable (%) | 0.43 | 0.33 | 0.24 | 0.23 | 0.21 |

TABLE 2

Injection Molding Processing Conditions.

| | Example | | | | |
|---|---|---|---|---|---|
| | 1, Comp. | 2 | 3 | 4 | 5 |
| Additives (Color & Formulation) | 1% red, 2% slip (1000 ppm slip) | 1% red, 2% slip (1000 ppm slip) | 1% red, 2% slip (1000 ppm slip) | 1% red, 2% slip, (1000 ppm slip) | 1% red, 2% slip (1000 ppm slip) |
| Part Weight - 4 cavities (g) | 8.653 | 8.625 | 8.61 | 8.557 | 8.567 |
| Injection Speed (mm/s) | 45 | 45 | 45 | 45 | 45 |
| Cycle time (s) | 3.631 | 3.631 | 3.616 | 3.505 | 3.634 |
| Filling time (s) | 0.661 | 0.661 | 0.672 | 0.542 | 0.661 |
| Dosing time (s) | 1.788 | 1.788 | 1.833 | 1.765 | 1.801 |
| Minimum Cushion (mm) | 9.758 | 9.742 | 9.748 | 9.697 | 9.746 |
| Filling peak pressure (psi) | 8294.6 | 10560.1 | 12628.8 | 12915.8 | 13134.3 |
| Full peak pressure (psi) | 8345 | 10569.1 | 12653.7 | 12933.3 | 13167.8 |
| Hold end position (mm) | 12.144 | 12.213 | 12.436 | 12.132 | 12.157 |

TABLE 2-continued

| Injection Molding Processing Conditions. | | | | | |
|---|---|---|---|---|---|
| | Example | | | | |
| | 1, Comp. | 2 | 3 | 4 | 5 |
| Clamp force (ton) | 17.1 | 17.2 | 18.9 | 17.8 | 17.1 |
| Fill start position (mm) | 39.461 | 34.468 | 34.952 | 39.467 | 39.462 |
| Dosing back pressure (psi) | 824.2 | 830.2 | 830.9 | 831.1 | 832.6 |
| Pack pressure (psi) | 8286.7 | 10163.8 | 12634.3 | 12922.1 | 13139.8 |
| Filling time 1 (s) | 0.665 | 0.665 | 0.676 | 0.546 | 0.661 |
| Temperature zone 1 (° C.) | 180 | 180 | 180 | 180 | 180 |
| Temperature zone 2 (° C.) | 185 | 185 | 185 | 185 | 185 |
| Temperature zone 3 (° C.) | 190 | 190 | 190 | 190 | 190 |
| Temperature zone 4 (°C.) | 200 | 200 | 200 | 200 | 200 |
| Temperature zone 5 (° C.) | 200 | 200 | 200 | 200 | 200 |
| Mold temperature stationary (° F.) | 58 | 58 | 58 | 58 | 58 |
| Mold temperature moving (° F.) | 58 | 58 | 58 | 58 | 58 |

TABLE 3

| Closure Dimensions | | | | | |
|---|---|---|---|---|---|
| | Example | | | | |
| | 1, Comp. | 2 | 3 | 4 | 5 |
| Additives (Color & Formulation) | 1% red, 2% slip (1000 ppm slip) | 1% red, 2% slip (1000 ppm slip) | 1% red, 2% slip (1000 ppm slip) | 1% red, 2% slip (1000 ppm slip) | 1% red, 2% slip (1000 ppm lip) |
| Closure height no Tamper Ring (mm) | 10.67 | 10.67 | 10.67 | 10.67 | 10.67 |
| Closure height with Tamper Ring (mm) | 15.44 | 15.38 | 15.32 | 15.25 | 15.27 |
| Outside diameter @ 4 mm (mm) | 29.58 | 29.59 | 29.61 | 29.56 | 29.59 |
| Thread diameter (mm) | 25.54 | 25.55 | 25.56 | 25.68 | 25.61 |
| Bump seal diameter (mm) | 24.52 | 24.54 | 24.45 | 24.47 | 24.40 |
| Bump seal thickness (mm) | 0.68 | 0.69 | 0.69 | 0.68 | 0.69 |
| Bump seal height to center of olive (mm) | 1.52 | 1.53 | 1.49 | 1.42 | 1.45 |
| Bore seal diameter (mm) | 22.5 | 22.53 | 22.50 | 22.44 | 22.46 |
| Bore seal thickness (mm) | 0.91 | 0.91 | 0.93 | 0.90 | 0.94 |
| Bore height to center of olive (mm) | 1.58 | 1.58 | 1.59 | 1.68 | 1.61 |
| Top panel thickness (mm) | 1.21 | 1.24 | 1.22 | 1.20 | 1.19 |
| Tamper band undercut diameter (mm) | 26.29 | 26.27 | 26.19 | 26.31 | 26.18 |
| Thread depth (mm) | 1.06 | 1.06 | 1.05 | 1.04 | 1.04 |
| Thread pitch (mm) | 2.54 | 2.62 | 2.62 | 2.70 | 2.57 |
| Thread Root @ 4 mm (mm) | 27.35 | 27.39 | 27.37 | 27.21 | 27.37 |
| Cap weight (g) | 2.164 | 2.167 | 2.158 | 2.134 | 2.143 |

Deformation Analysis of Solid-State Closures

A DHR-3 rotational rheometer testing bar was modified by attaching an annular probe (see FIGS. 2A and 2B) to its end. This set up was used for the compressive deformation tests. The rheometer has a temperature chamber (oven) that allows one to measure the deformation responses at different temperatures. The annular probe made had an inner diameter of 6.4 mm and an outer diameter of 10.8 mm. The annular structure is designed to avoid contact of the probe with the center of the top panel of a closure since sometimes the gate mark (due to the nature of the injection molding process) is not completely flat (note: closures made by continuous compression molding processes will normally not have such marks at the center of the top panel of the closure). A closure holder (see FIG. 3) was also designed to hold the closure. This holder has four setting screws to fix the position of the closure inside the holder. The probe is glued to the testing bar using high temperature resistant silicone grease. The projected or contact area of the closure surface to be put under stress was 0.5944 $cm^2$. Tamper-evident rings were removed from the closures prior to testing, so that only the deformation of the top panel at the projected area was induced. The closure without tamper-evident ring is fixed in the stainless steel secure ring closure holder (see FIG. 3) and placed on the bottom plate of the rheometer. The point where the probe first touches the closure is set as the zero position. For the time sweep test, the sample was conditioned in the oven for 15 minutes at 93° C. before the testing started. A person skilled in the art will recognize that the present testing can be carried out at any suitable temperature for obtaining results, and especially any temperature above ambient to obtain results applicable to use of closures in hot fill or aseptic fill processes. An initial 2.5 N compression force was applied and then the time sweep was carried out with 1 rad/s frequency and 0.0001% radial strain for 300 seconds at 93° C. (which at such a low value does not affect axial responses; if higher radial strain were used, the solid samples might induce distortions in the axial force and deformation, ΔL data obtained). During this process, the instantaneous compressive force and deformation measured as ΔL vs. time were recorded. The compressive strain e (taken as a positive value for modeling purposes, see below) is calculated by taking the ratio of ΔL/thickness (in mm) of the closure top panel. The stress undergone at the contact area is calculated by using the recorded force divided by the actual contact area (i.e., 0.5944 $cm^2$). The data provided in Table 4 is an example data set obtained for each closure, and came from the modified solid-state deformation analysis carried out on each closure (Time in seconds, Axial Force in Newtons, Deformation or DL in mm, Temperature in ° C. and Angular Frequency, in radians per second). The data from each closure was modeled to obtain the strain model parameters (A, n and m). The data reported in Tables 4A-4E show one set of values for the raw data obtained by the above described deformation test for each closure made of a specific resin. In practice, data were collected for 4 to 6 closures made from each resin. The data from the 4-6 closures measured for each resin type was used as the basis for modeling after converting the axial force to stress and the deformation to strain. The numbers obtained with the model (on the closure/resin systems) were then averaged and are provided below in Table 5. Without wishing to be bound by theory, it is believed that the compressive deformation resistance evaluated using the current methodology also reflects the deformation resistance under any other deformation modes, such as tensile deformation; it is further believed that the deformation of the top panel of an as-is closure approximates that which occurs between the mechanically sealing surfaces of a plastic closure and a PET bottle neck finish after a closure is secured to a PET bottle.

TABLE 4A

| Example 1 | | | | | | | | |
|---|---|---|---|---|---|---|---|---|
| Time (s) | Force (N) | DL (mm) | Top panel thickness (mm) | Projected Area ($cm^2$) | Temperature (° C.) | Angular frequency (rad/s) | Strain | Stress ($N/cm^2$) |
| 13.1815 | 0.3748 | 0.1319 | 1.21 | 0.5944 | 93.01 | 1 | 10.9% | 0.6305 |
| 27.1430 | 0.9321 | 0.1827 | 1.21 | 0.5944 | 93 | 1 | 15.1% | 1.5681 |
| 41.2604 | 1.3460 | 0.2207 | 1.21 | 0.5944 | 93 | 1 | 18.2% | 2.2644 |
| 55.0815 | 1.6385 | 0.2480 | 1.21 | 0.5944 | 93.01 | 1 | 20.5% | 2.7566 |
| 68.9493 | 1.8469 | 0.2687 | 1.21 | 0.5944 | 93.01 | 1 | 22.2% | 3.1071 |
| 83.5972 | 2.0062 | 0.2853 | 1.21 | 0.5944 | 93.01 | 1 | 23.6% | 3.3751 |
| 97.5586 | 2.1170 | 0.2974 | 1.21 | 0.5944 | 93 | 1 | 24.6% | 3.5616 |
| 111.3953 | 2.1974 | 0.3067 | 1.21 | 0.5944 | 92.99 | 1 | 25.3% | 3.6969 |
| 125.3256 | 2.2625 | 0.3141 | 1.21 | 0.5944 | 93 | 1 | 26.0% | 3.8064 |
| 139.3807 | 2.3090 | 0.3201 | 1.21 | 0.5944 | 93 | 1 | 26.5% | 3.8846 |
| 153.4513 | 2.3473 | 0.3249 | 1.21 | 0.5944 | 93 | 1 | 26.9% | 3.9490 |
| 167.3348 | 2.3736 | 0.3288 | 1.21 | 0.5944 | 92.99 | 1 | 27.2% | 3.9933 |
| 181.2494 | 2.3928 | 0.3319 | 1.21 | 0.5944 | 93 | 1 | 27.4% | 4.0256 |
| 195.1485 | 2.4085 | 0.3347 | 1.21 | 0.5944 | 92.99 | 1 | 27.7% | 4.0520 |
| 208.9384 | 2.4204 | 0.3370 | 1.21 | 0.5944 | 93 | 1 | 27.9% | 4.0720 |
| 222.9310 | 2.4293 | 0.3391 | 1.21 | 0.5944 | 93 | 1 | 28.0% | 4.0869 |
| 237.0173 | 2.4381 | 0.3409 | 1.21 | 0.5944 | 92.99 | 1 | 28.2% | 4.1018 |
| 251.0100 | 2.4449 | 0.3425 | 1.21 | 0.5944 | 93 | 1 | 28.3% | 4.1132 |
| 264.7530 | 2.4306 | 0.3425 | 1.21 | 0.5944 | 92.99 | 1 | 28.3% | 4.0891 |
| 278.3245 | 2.4216 | 0.3425 | 1.21 | 0.5944 | 93 | 1 | 28.3% | 4.0740 |
| 292.0208 | 2.4114 | 0.3425 | 1.21 | 0.5944 | 93 | 1 | 28.3% | 4.0569 |
| 305.8886 | 2.4020 | 0.3425 | 1.21 | 0.5944 | 92.99 | 1 | 28.3% | 4.0411 |

TABLE 4B

| Example 2 | | | | | | | | |
|---|---|---|---|---|---|---|---|---|
| Time (s) | Force (N) | DL (mm) | Top panel thickness (mm) | Projected Area ($cm^2$) | Temperature (° C.) | Angular frequency (rad/s) | Strain | Stress ($N/cm^2$) |
| 13.3687 | 0.3667 | 0.1330 | 1.24 | 0.5944 | 93.01 | 1 | 10.7% | 0.6169 |
| 27.3301 | 0.9279 | 0.1833 | 1.24 | 0.5944 | 93.01 | 1 | 14.8% | 1.5610 |
| 41.2604 | 1.2998 | 0.2218 | 1.24 | 0.5944 | 93.01 | 1 | 17.9% | 2.1868 |
| 55.2063 | 1.6199 | 0.2502 | 1.24 | 0.5944 | 93.01 | 1 | 20.2% | 2.7253 |
| 69.1677 | 1.8470 | 0.2713 | 1.24 | 0.5944 | 93 | 1 | 21.9% | 3.1074 |
| 83.3008 | 2.0061 | 0.2874 | 1.24 | 0.5944 | 93 | 1 | 23.2% | 3.3750 |
| 97.9954 | 2.1236 | 0.3000 | 1.24 | 0.5944 | 93 | 1 | 24.2% | 3.5727 |
| 112.0193 | 2.2041 | 0.3094 | 1.24 | 0.5944 | 93 | 1 | 25.0% | 3.7081 |
| 126.1056 | 2.2669 | 0.3167 | 1.24 | 0.5944 | 93.01 | 1 | 25.5% | 3.8137 |
| 140.1606 | 2.3178 | 0.3224 | 1.24 | 0.5944 | 93 | 1 | 26.0% | 3.8994 |
| 154.0753 | 2.3540 | 0.3270 | 1.24 | 0.5944 | 93 | 1 | 26.4% | 3.9604 |
| 167.9587 | 2.3795 | 0.3307 | 1.24 | 0.5944 | 92.99 | 1 | 26.7% | 4.0031 |
| 181.9358 | 2.3994 | 0.3338 | 1.24 | 0.5944 | 92.99 | 1 | 26.9% | 4.0366 |
| 196.0221 | 2.4147 | 0.3363 | 1.24 | 0.5944 | 93 | 1 | 27.1% | 4.0624 |

TABLE 4B-continued

| Example 2 | | | | | | | | |
|---|---|---|---|---|---|---|---|---|
| Time (s) | Force (N) | DL (mm) | Top panel thickness (mm) | Projected Area ($cm^2$) | Temperature (° C.) | Angular frequency (rad/s) | Strain | Stress ($N/cm^2$) |
| 209.9523 | 2.4293 | 0.3385 | 1.24 | 0.5944 | 93 | 1 | 27.3% | 4.0870 |
| 224.0230 | 2.4397 | 0.3403 | 1.24 | 0.5944 | 93 | 1 | 27.4% | 4.1044 |
| 237.7505 | 2.4356 | 0.3410 | 1.24 | 0.5944 | 93 | 1 | 27.5% | 4.0975 |
| 251.4779 | 2.4224 | 0.3410 | 1.24 | 0.5944 | 93 | 1 | 27.5% | 4.0754 |
| 265.0182 | 2.4105 | 0.3410 | 1.24 | 0.5944 | 93 | 1 | 27.5% | 4.0553 |
| 278.9329 | 2.4112 | 0.3416 | 1.24 | 0.5944 | 93 | 1 | 27.5% | 4.0566 |
| 292.7383 | 2.4315 | 0.3438 | 1.24 | 0.5944 | 93 | 1 | 27.7% | 4.0907 |
| 306.4970 | 2.4204 | 0.3438 | 1.24 | 0.5944 | 93.01 | 1 | 27.7% | 4.0720 |

15

TABLE 4C

| Example 3 | | | | | | | | |
|---|---|---|---|---|---|---|---|---|
| Time (s) | Force (N) | DL (mm) | Top panel thickness (mm) | Projected Area ($cm^2$) | Temperature (° C.) | Angular frequency (rad/s) | Strain | Stress ($N/cm^2$) |
| 13.2907 | 0.5481 | 0.1308 | 1.22 | 0.5944 | 92.97 | 1 | 10.7% | 0.9221 |
| 27.3301 | 1.2390 | 0.1748 | 1.22 | 0.5944 | 92.99 | 1 | 14.3% | 2.0845 |
| 41.2760 | 1.6528 | 0.2036 | 1.22 | 0.5944 | 93 | 1 | 16.7% | 2.7807 |
| 55.1907 | 1.9107 | 0.2231 | 1.22 | 0.5944 | 93.01 | 1 | 18.3% | 3.2145 |
| 69.1989 | 2.0847 | 0.2369 | 1.22 | 0.5944 | 93.01 | 1 | 19.4% | 3.5072 |
| 83.0980 | 2.1998 | 0.2466 | 1.22 | 0.5944 | 93.01 | 1 | 20.2% | 3.7009 |
| 97.1687 | 2.2781 | 0.2538 | 1.22 | 0.5944 | 93.01 | 1 | 20.8% | 3.8326 |
| 111.0989 | 2.3328 | 0.2591 | 1.22 | 0.5944 | 93.02 | 1 | 21.2% | 3.9247 |
| 125.0292 | 2.3692 | 0.2633 | 1.22 | 0.5944 | 93 | 1 | 21.6% | 3.9859 |
| 138.8035 | 2.3951 | 0.2665 | 1.22 | 0.5944 | 93 | 1 | 21.8% | 4.0295 |
| 152.9677 | 2.4163 | 0.2691 | 1.22 | 0.5944 | 93 | 1 | 22.1% | 4.0651 |
| 166.9916 | 2.4314 | 0.2712 | 1.22 | 0.5944 | 92.99 | 1 | 22.2% | 4.0905 |
| 180.9374 | 2.4422 | 0.2730 | 1.22 | 0.5944 | 92.99 | 1 | 22.4% | 4.1087 |
| 194.5869 | 2.4360 | 0.2738 | 1.22 | 0.5944 | 92.98 | 1 | 22.4% | 4.0982 |
| 208.3456 | 2.4221 | 0.2738 | 1.22 | 0.5944 | 92.99 | 1 | 22.4% | 4.0748 |
| 221.9327 | 2.4082 | 0.2738 | 1.22 | 0.5944 | 92.99 | 1 | 22.4% | 4.0514 |
| 235.6757 | 2.4366 | 0.2757 | 1.22 | 0.5944 | 92.99 | 1 | 22.6% | 4.0993 |
| 249.4344 | 2.4284 | 0.2763 | 1.22 | 0.5944 | 93 | 1 | 22.6% | 4.0854 |
| 263.2399 | 2.4162 | 0.2763 | 1.22 | 0.5944 | 92.99 | 1 | 22.6% | 4.0650 |
| 276.9829 | 2.4077 | 0.2763 | 1.22 | 0.5944 | 92.99 | 1 | 22.6% | 4.0507 |
| 290.6324 | 2.4346 | 0.2783 | 1.22 | 0.5944 | 93 | 1 | 22.8% | 4.0959 |
| 304.3911 | 2.4237 | 0.2783 | 1.22 | 0.5944 | 93 | 1 | 22.8% | 4.0775 |

TABLE 4D

| Example 4 | | | | | | | | |
|---|---|---|---|---|---|---|---|---|
| Time (s) | Force (N) | DL (mm) | Top panel thickness (mm) | Projected Area ($cm^2$) | Temperature (° C.) | Angular frequency (rad/s) | Strain | Stress ($N/cm^2$) |
| 13.17669 | 0.4737 | 0.1315 | 1.20 | 0.5944 | 92.99 | 1 | 11.0% | 0.7970 |
| 27.09536 | 1.1246 | 0.1780 | 1.20 | 0.5944 | 92.99 | 1 | 14.8% | 1.8919 |
| 40.91643 | 1.5340 | 0.2096 | 1.20 | 0.5944 | 92.99 | 1 | 17.5% | 2.5808 |
| 55.00269 | 1.8265 | 0.2322 | 1.20 | 0.5944 | 92.99 | 1 | 19.4% | 3.0729 |
| 68.97974 | 2.0128 | 0.2482 | 1.20 | 0.5944 | 92.99 | 1 | 20.7% | 3.3862 |
| 82.92561 | 2.1419 | 0.2597 | 1.20 | 0.5944 | 93 | 1 | 21.6% | 3.6035 |
| 96.88707 | 2.2355 | 0.2683 | 1.20 | 0.5944 | 93 | 1 | 22.4% | 3.7610 |
| 111.0045 | 2.3020 | 0.2747 | 1.20 | 0.5944 | 93 | 1 | 22.9% | 3.8727 |
| 125.1532 | 2.3454 | 0.2796 | 1.20 | 0.5944 | 93 | 1 | 23.3% | 3.9458 |
| 139.1926 | 2.3785 | 0.2835 | 1.20 | 0.5944 | 93 | 1 | 23.6% | 4.0015 |
| 152.9669 | 2.3995 | 0.2865 | 1.20 | 0.5944 | 93.01 | 1 | 23.9% | 4.0369 |
| 167.022 | 2.4163 | 0.2890 | 1.20 | 0.5944 | 92.99 | 1 | 24.1% | 4.0652 |
| 181.0926 | 2.4303 | 0.2912 | 1.20 | 0.5944 | 93.01 | 1 | 24.3% | 4.0887 |
| 195.0385 | 2.4402 | 0.2930 | 1.20 | 0.5944 | 93 | 1 | 24.4% | 4.1052 |
| 208.7348 | 2.4427 | 0.2943 | 1.20 | 0.5944 | 93 | 1 | 24.5% | 4.1095 |
| 222.5714 | 2.4227 | 0.2943 | 1.20 | 0.5944 | 92.99 | 1 | 24.5% | 4.0759 |
| 236.2521 | 2.4071 | 0.2943 | 1.20 | 0.5944 | 93 | 1 | 24.5% | 4.0497 |

TABLE 4D-continued

| Example 4 | | | | | | | | |
|---|---|---|---|---|---|---|---|---|
| Time (s) | Force (N) | DL (mm) | Top panel thickness (mm) | Projected Area ($cm^2$) | Temperature (° C.) | Angular frequency (rad/s) | Strain | Stress ($N/cm^2$) |
| 249.9688 | 2.4369 | 0.2966 | 1.20 | 0.5944 | 93 | 1 | 24.7% | 4.0997 |
| 263.7275 | 2.4179 | 0.2966 | 1.20 | 0.5944 | 93.01 | 1 | 24.7% | 4.0678 |
| 277.3925 | 2.4049 | 0.2966 | 1.20 | 0.5944 | 93 | 1 | 24.7% | 4.0460 |
| 290.9484 | 2.4338 | 0.2986 | 1.20 | 0.5944 | 93 | 1 | 24.9% | 4.0946 |
| 304.5667 | 2.4193 | 0.2986 | 1.20 | 0.5944 | 93 | 1 | 24.9% | 4.0702 |

TABLE 4E

| Example 5 | | | | | | | | |
|---|---|---|---|---|---|---|---|---|
| Time (s) | Force (N) | DL (mm) | Top panel thickness (mm) | Projected Area ($cm^2$) | Temperature (° C.) | Angular frequency (rad/s) | Strain | Stress ($N/cm^2$) |
| 13.2439 | 0.6324 | 0.1420 | 1.19 | 0.5944 | 93 | 1 | 11.9% | 1.0640 |
| 27.1742 | 1.3407 | 0.1830 | 1.19 | 0.5944 | 93 | 1 | 15.4% | 2.2556 |
| 41.1824 | 1.7544 | 0.2090 | 1.19 | 0.5944 | 93.01 | 1 | 17.6% | 2.9515 |
| 55.9082 | 2.0004 | 0.2267 | 1.19 | 0.5944 | 93.01 | 1 | 19.1% | 3.3653 |
| 69.9165 | 2.1563 | 0.2381 | 1.19 | 0.5944 | 93.01 | 1 | 20.0% | 3.6277 |
| 83.9560 | 2.2612 | 0.2461 | 1.19 | 0.5944 | 93.01 | 1 | 20.7% | 3.8042 |
| 97.8550 | 2.3278 | 0.2518 | 1.19 | 0.5944 | 93.01 | 1 | 21.2% | 3.9162 |
| 111.7385 | 2.3722 | 0.2559 | 1.19 | 0.5944 | 93 | 1 | 21.5% | 3.9909 |
| 125.7528 | 2.3995 | 0.2590 | 1.19 | 0.5944 | 92.99 | 1 | 21.8% | 4.0368 |
| 139.6794 | 2.4185 | 0.2615 | 1.19 | 0.5944 | 92.99 | 1 | 22.0% | 4.0688 |
| 153.7813 | 2.4343 | 0.2636 | 1.19 | 0.5944 | 93 | 1 | 22.2% | 4.0954 |
| 167.8519 | 2.4440 | 0.2653 | 1.19 | 0.5944 | 93 | 1 | 22.3% | 4.1117 |
| 181.6574 | 2.4252 | 0.2656 | 1.19 | 0.5944 | 92.99 | 1 | 22.3% | 4.0800 |
| 195.4161 | 2.4080 | 0.2656 | 1.19 | 0.5944 | 92.99 | 1 | 22.3% | 4.0511 |
| 209.0656 | 2.4463 | 0.2676 | 1.19 | 0.5944 | 93 | 1 | 22.5% | 4.1156 |
| 222.7930 | 2.4225 | 0.2675 | 1.19 | 0.5944 | 93 | 1 | 22.5% | 4.0755 |
| 236.3957 | 2.4087 | 0.2675 | 1.19 | 0.5944 | 92.99 | 1 | 22.5% | 4.0523 |
| 250.0920 | 2.4318 | 0.2689 | 1.19 | 0.5944 | 93 | 1 | 22.6% | 4.0912 |
| 263.8507 | 2.4187 | 0.2690 | 1.19 | 0.5944 | 92.99 | 1 | 22.6% | 4.0691 |
| 277.5313 | 2.4074 | 0.2689 | 1.19 | 0.5944 | 93.01 | 1 | 22.6% | 4.0502 |
| 291.1340 | 2.4321 | 0.2704 | 1.19 | 0.5944 | 93 | 1 | 22.7% | 4.0917 |
| 304.9083 | 2.4166 | 0.2704 | 1.19 | 0.5944 | 93.01 | 1 | 22.7% | 4.0656 |

A person skilled in the art will recognize that any resin which is capable of being formed into a closure may be subjected to similar testing to provide inputs for use in the compressive strain model, so that two or more closures made of different polymeric material may be directly compared and contrasted with respect to their respective deformation behavior.

The Compressive Strain Model

Without wishing to be bound by any single theory, the responses collected for each closure reflect the characteristics of the resin used in each closure. However, since the instantaneous compressive deformation information is a function of both time and stress, which is a non-linear relationship or typical multivariate phenomenon, a model is employed to provide a better understanding of the polymer structure-closure property relationship. The model used here is a model that can adequately describe the closure deformation as a function of stress and time at a given temperature for each polymer-closure pairing.

The compressive strain data obtained as described above are modeled using a compressive strain model in order to compare the tendency of a polymer-closure system to deform under stress. Together with the compressive strain data, the model is a useful method to provide rapid and cost effective manner by which to predict polymer-closure pairing deformation properties.

The compressive strain is assumed to follow the mathematical form at a given temperature as shown below:

$$\varepsilon = A \times \sigma^n \times t^m$$

where ε is the compressive strain; σ is the stress in $N/cm^2$, t is the loading time in seconds, A is the model coefficient, n is the deformation stress exponent and m is the time exponent. Any software capable of performing non-linear regressions can be used to estimate the model parameters.

Figure 4:
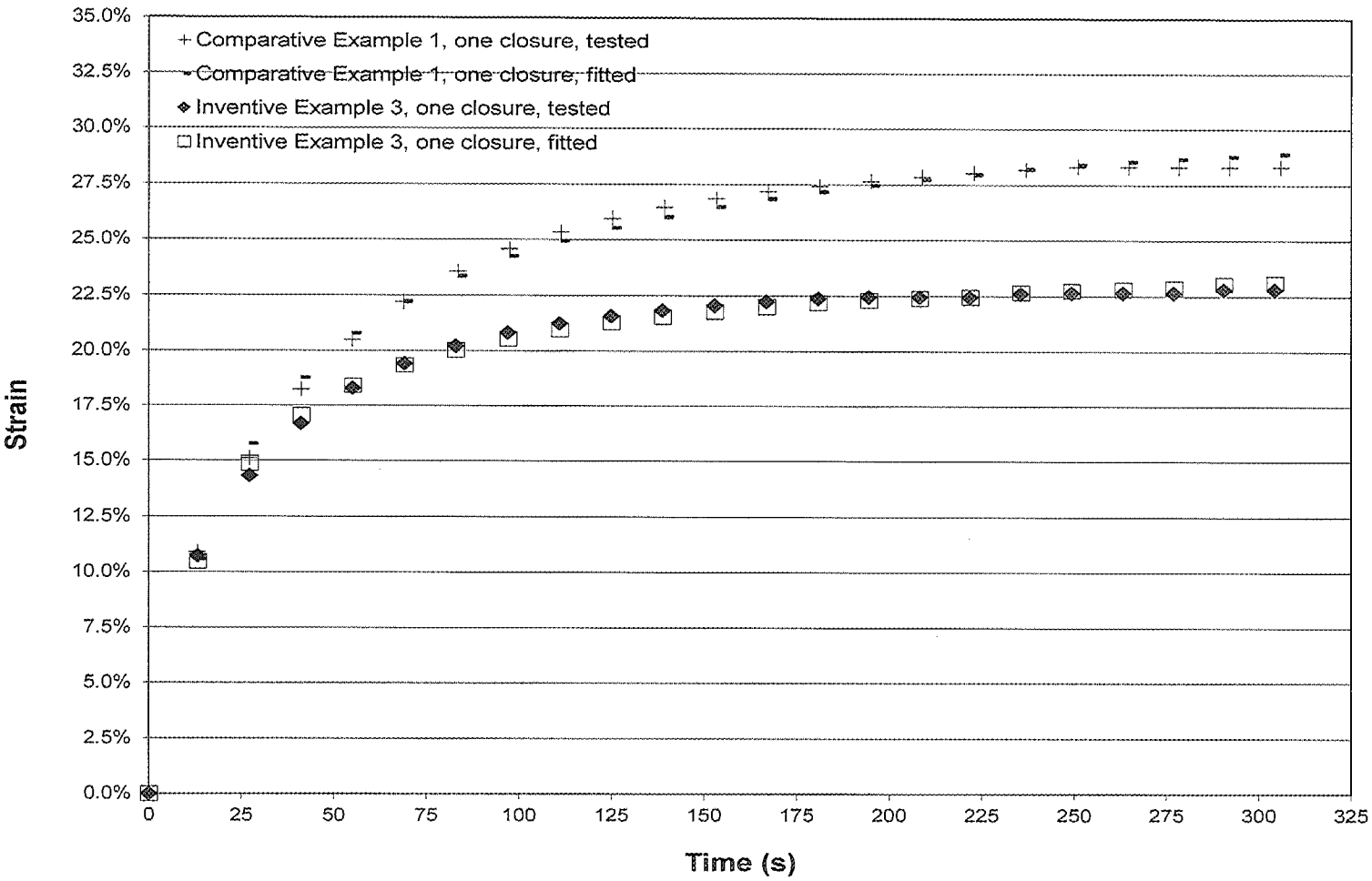
FIG. 4 shows actual and fitted compressive deformation data for the closures of Example 1 and Example 3.

FIG. 4 shows the actual and fitted compressive strains (deformations) using the compressive strain model for Examples 1 and 3. Generally, the model fits very well with the actual deformation obtained from the closures made from the different polymer types. The average values of the fitted model parameters, A, n and m, are summarized in Table 5.

TABLE 5

Compressive Strain Model Parameters for Closures Made of Different Polyethylene Polymers and Predicted Creep

| | Example | | | | |
|---|---|---|---|---|---|
| | 1, Comp. | 2 | 3 | 4 | 5 |
| Additives (Color & Slip by Masterbatch, MB) | 1% red, 2% slip (1000 ppm slip) | 1% red, 2% slip (1000 ppm slip) | 1% red, 2% slip (1000 ppm slip) | 1% red, 2% slip (1000 ppm slip) | 1% red, 2% slip (1000 ppm slip) |
| Model Coefficient, A | 0.093679 | 0.094526 | 0.091060 | 0.094422 | 0.096656 |
| Deformation stress exponent, n | 0.348888 | 0.354528 | 0.343505 | 0.364388 | 0.362758 |
| Time Exponent, m | 0.115313 | 0.103635 | 0.088631 | 0.08724 | 0.073986 |
| Predicted creep strain at 93° C., 4 N/cm$^2$, 305 seconds; the stress is constant and creep is the deformation vs time | 29.4% | 28.0% | 24.3% | 25.8% | 24.4% |

Predicted creep strain (also shown in Table 5) is the deformation of a material at a specific time under a constant stress. Since the model described above for compressive strain fits the actual raw data very well, the model may be further used to predict the deformations under different conditions, such as increased stress levels, or predicting compressive strain at various stress values at a constant loading time.

The data provided in Table 5 clearly shows that Examples 2-5 have lower time exponent (m) values and better creep or deformation resistance when compared to Example 1. The time exponent values for Examples 2-5 are all lower than 0.114. The lower the time exponent value with A and n parameters being essentially the same, the better the closure/polymer system resists deformation. As the deformation at elevated temperature is believed to be important to whether a particular polymer/closure system is suitable for a use in a hot-filling or aseptic filling process, the present model helps to establish which polyethylene resins are suitable in such end use applications.

Preparation of a Liquid Containing 4.2 Volume % $CO_2$ Sealed in a PET Container with a Closure To prepare 4.2 vol % of carbon dioxide, $CO_2$ (4.2 Gas Volume or "GV") in purified water, 10.13 grams of sodium bicarbonate ($NaHCO_3$) and 7.72 grams of citric acid ($C_6H_8O_7$) were packed into two water-soluble EVOH (ethylene vinyl alcohol) bags. Next, 600 mL of purified water was added to a PET bottle filling the bottle. Each bottle had a PCO 1881 neck finish. The bag with sodium bicarbonate and the bag with citric acid were then added to the PET bottle filled with purified water. A closure was immediately placed on the PET bottle with manual force and turned at an application angle 360°. Next the bottle-closure system was placed in a Steinfurth torque measuring machine with a proper chuck to further turn the closure at an application angle of 380° at a speed of 0.8 rpm/minute. The bottle was then shaken to ensure complete dissolution of the chemicals in water.

Elevated Temperature Cycle Test (ETCT)

This is an International Society of Beverage Technologists (ISBT) voluntary standard test. As closures may experience wide temperature swings in hot weather markets, it is preferred that the closure remain on the neck finish during these temperature swings and throughout the shelf life of the product. The elevated temperature cycle test evaluates such closure performance.

After filling and capping a PET bottle with 4.2 GV of $CO_2$ as described above, the PET bottle-closure system was placed in a temperature controlled chamber. The bottle-closure system was then exposed to the following temperature program: Cycle 1; A) hold at 60° C. for 6 hours, then B) at 32° C. for 18 hours; Cycle 2; C) hold at 60° C. for six 6 hours, then D) at 32° C. for 18 hours; Cycle 3; E) hold at 60° C. for 6 hours, then F) at 32° C. for 18 hours. After each cycle component, the PET bottle-closure samples were observed for closure releases, cocked and deformed closures and leakers. A total of 24 bottle-closure systems were tested in each example. The results are shown in Table 6.

TABLE 6[1,2,]

Elevated Temperature Cycle Test of a PET bottle - PE closure System (closure has additives for color, 1% red, and slip, 1000 ppm by way of 2% masterbatch)

| Example | Cycle | Cycle Half | No. of Failures | Visual Inspection of Closures | % Pass (no issue) |
|---|---|---|---|---|---|
| 1, Comp. | 1 | A | No failure | | 33.3% |
| | | B | No failure | | |
| | 2 | C | 2 | Nos. 10 and 24 had visual flaws | |
| | | D | 4 | Nos. 4, 6, 7, and 21 had visual flaws | |
| | 3 | E | 3 | Nos. 12 and 20 had visual flaws; No. 11 vented gas | |
| | | F | 7 | Nos. 2 and 3 had visual flaws; Nos. 5, 14, 17, 22, and 23 vented gas | |

TABLE 6[1,2]-continued

Elevated Temperature Cycle Test of a PET bottle - PE closure System
(closure has additives for color, 1% red, and slip, 1000 ppm by way of 2% masterbatch)

| Example | Cycle | Cycle Half | No. of Failures | Visual Inspection of Closures | % Pass (no issue) |
|---|---|---|---|---|---|
| 2 | 1 | A | 14 | | 0% |
| | | B | 6 | | |
| | 2 | C | 4 | | |
| | | D | | | |
| | 3 | E | | | |
| | | F | | | |
| 3 | 1 | A | 22 | Nos. 1, 2, 3, 4, 5, 6, 7, 9, 10, 11, 12, 13, 14, 15, 16, 17, 18, 19, 20, 22, 23, 24, tamper evident band (TEB) separated | 4% |
| | | B | No failure | | |
| | 2 | C | 1 | No. 21 tamper-evident band separated | |
| | | D | No failure | | |
| | 3 | E | No failure | | |
| | | F | No failure | | |
| 4 | 1 | A | No failure | | 37.5% |
| | | B | No failure | | |
| | 2 | C | 2 | | |
| | | D | 4 | | |
| | 3 | E | 3 | | |
| | | F | 7 | | |
| 5 | 1 | A | No failure | | 33.3% |
| | | B | No failure | | |
| | 2 | C | 2 | Nos. 10 and 12 had visual flaws | |
| | | D | 4 | Nos. 4, 6, 7 and 21 had visual flaws | |
| | 3 | E | 3 | Nos. 12, 20 - had visual flaws; No. 11 vented gas | |
| | | F | 7 | Nos. 2, 3 - had visual flaws; Nos. 5, 14, 17, 22, 23 vented gas | |

Notes:
[1]PET bottle used: CSD, PCO 1881 neck finish, 591 ml.
[2]No. of specimens: 24

Examination of the data in Table 6, shows that Examples 1-5 have variable heat cycling performance but where Example 4, a unimodal homopolymer of ethylene, was the best performer. For Example 4 a closure pass rate of about 37.5% was achieved.

Secure Seal Test (SST)

As PET (or glass) is more rigid than polyethylene, the deformation at the mechanically sealing surfaces of a bottle and closure package likely occurs more with the plastic closure than the bottle. Hence, it is important that the plastic closure has an appropriate deformation. Without wishing to be bound by theory, it is expected that an excessive deformation of the closure at the mechanically sealing surfaces may lead to the loss of the intimate engagement of the sealing surfaces at some point. Insufficient deformation of the closure at the mechanically sealing surfaces may not provide sufficient conformability to the shapes of the sealing surfaces on the rigid PET bottle neck finish. Appropriate deformation at the mechanically sealing surfaces can provide the intimate engagement between the sealing surfaces of the bottle (neck finish) and closure. Hence, a closure exhibiting excessive compressive strain or excessive deformation may lead to poorer sealing properties (e.g. decreased tightness) when the closure is fitted to a PET container, bottle and the like; alternatively, a closure exhibiting appropriate compressive strain or deformation may lead to improved sealing properties (e.g. improved tightness) when the closure is fitted to a PET container, bottle and the like.

The SST is an International Society of Beverage Technologists (ISBT) voluntary standard test. This test is to determine the plastic closure seal and thread integrity while under an internal pressure. A detailed description of the test follows. After filling and capping a PET bottle with 4.2 GV of $CO_2$ as described above, the PET bottle-closure system was conditioned at room temperature (22° C.+/−1° C.) for 24 hours. Next, the PET bottle neck finish including the closure, was cut out using a Secure-Pak™ neck finish cutting tool. The combined neck finish/closure system was attached in a sealed fit with a pressure tubing and gas pressure was introduced. The PET neck finish/closure system was placed into a testing fixture and the entire assembly was placed into a water tank of a Secure Seal Tester, model SST, manufactured by Secure Pak (Maumee, Ohio). The test was carried out in water at room temperature (22° C.). The pressure was slowly applied to the interior of the closure to 100 Psi and held for a period of 1 minute. The PET bottle neck finish-closure sample was observed for signs of air bubbles. A failure is indicated when a steady stream of bubbles emitting from the closure can be observed. In a next step, the pressure was increased to 175 psi and held for one 1 minute to again look for evidence of air bubbles. In a final step, the pressure was increased to 200 psi and held for 1 minute, and evidence of air bubbles was looked for. The pressures at which observable air leakage events occurred were recorded as well as the percentage of air passage.

A total of twenty Secure Seal tests were carried out for each of Examples 1-5 and the results are provided in Table 7.

TABLE 7

Secure Seal Test (SST) of a PET bottle - PE closure System (closure has additives for color, 1% red, and slip, 1000 ppm by way of 2% masterbatch)

| Example | Specimen No. | P1 Leakage @ 100 psi, No. of failures | Maximum Pressure attained in psi with elapsed time before failure (seconds) | Specimen No. | P1 Leakage @ 100 psi, No. of failures | Maximum Pressure attained in psi with elapsed time before failure (seconds) |
|---|---|---|---|---|---|---|
| 1, Comp. | 1 | 0 | 175 (10 sec) | 11 | 0 | 175 (12 sec) |
| | 2 | 0 | 155 | 12 | 0 | 200 |
| | 3 | 0 | 175 (55 sec) | 13 | 0 | 175 (37 sec) |
| | 4 | 0 | 135 | 14 | 0 | 175 (10 sec) |
| | 5 | 0 | 175 (45 sec) | 15 | 0 | 175 (8 sec) |
| | 6 | 0 | 175 (0 sec) | 16 | 0 | 175 (4 sec) |
| | 7 | 0 | 180 | 17 | 0 | 165 |
| | 8 | 0 | 160 | 18 | 0 | 150 |
| | 9 | 0 | 175 (8 sec) | 19 | 0 | 160 |
| | 10 | 0 | 175 (42 sec) | 20 | 0 | 175 (9 sec) |
| | No. of specimens not lasting 175 psi for 1 minute = 18; % Pass >175 psi for 1 minute = 10% | | | | | |
| 2 | 1 | 0 | 100 | 11 | 0 | 200 |
| | 2 | 0 | 200 | 12 | 0 | 175 (<60 sec) |
| | 3 | 0 | 200 | 13 | 0 | 200 |
| | 4 | 0 | 175 (<60 sec) | 14 | 0 | 175 (<60 sec) |
| | 5 | 0 | 200 | 15 | 0 | 175 |
| | 6 | 0 | 200 | 16 | 0 | 175 (<60 sec) |
| | 7 | 0 | 175 (<60 sec) | 17 | 0 | 200 |
| | 8 | 0 | 175 (<60 sec) | 18 | 0 | 200 |
| | 9 | 0 | 200 | 19 | 0 | 175 (<60 sec) |
| | 10 | 0 | 200 | 20 | 0 | 175 (<60 sec) |
| | No. of specimens not lasting 175 psi for 1 minute = 10; % Pass >175 psi for 1 minute = 50% | | | | | |
| 3 | 1 | 0 | 180 | 11 | 0 | 200 |
| | 2 | 0 | 175 (28 sec) | 12 | 0 | 175 |
| | 3 | 0 | 200 | 13 | 0 | 200 |
| | 4 | 0 | 200 | 14 | 0 | 200 |
| | 5 | 0 | 200 | 15 | 0 | 200 |
| | 6 | 0 | 200 | 16 | 0 | 195 |
| | 7 | 0 | 200 | 17 | 0 | 200 |
| | 8 | 0 | 200 | 18 | 0 | 200 |
| | 9 | 0 | 200 | 19 | 0 | 200 |
| | 10 | 0 | 200 | 20 | 0 | 175 (28 sec) |
| | No. of specimens not lasting 175 psi for 1 minute = 2; % Pass >175 psi for 1 minute = 90%, 2 specimens did not get to 175 psi for one minute and 4 specimens did not achieve 200 psi. | | | | | |
| 4 | 1 | 0 | 200 | 11 | 0 | 200 |
| | 2 | 0 | 200 | 12 | 0 | 175 (55 sec) |
| | 3 | 0 | 200 | 13 | 0 | 200 |
| | 4 | 0 | 200 | 14 | 0 | 200 |
| | 5 | 0 | 200 | 15 | 0 | 200 |
| | 6 | 0 | 200 | 16 | 0 | 200 |
| | 7 | 0 | 200 | 17 | 0 | 200 |
| | 8 | 0 | 200 | 18 | 0 | 170 |
| | 9 | 0 | 200 | 19 | 0 | 200 |
| | 10 | 0 | 200 | 20 | 0 | 200 |
| | No. of specimens not lasting 175 psi for 1 minute = 2; % Pass >175 psi for 1 minute = 90% | | | | | |
| 5 | 1 | 0 | 200 | 11 | 0 | 200 |
| | 2 | 0 | 200 | 12 | 0 | 140 |
| | 3 | 0 | 190 | 13 | 0 | 200 |
| | 4 | 0 | 200 | 14 | 0 | 200 |
| | 5 | 0 | 200 | 15 | 0 | 200 |
| | 6 | 0 | 175 (20 sec) | 16 | 0 | 200 |
| | 7 | 0 | 200 | 17 | 0 | 200 |
| | 8 | 0 | 175 (10 sec) | 18 | 0 | 200 |
| | 9 | 0 | 200 | 19 | 0 | 200 |
| | 10 | 0 | 200 | 20 | 0 | 200 |
| | No. of specimens not lasting 175 psi for 1 minute = 3; % Pass >175 psi for 1 minute = 85% | | | | | |

Examination of the data in Table 7, shows that Example 1, where the closure is made from SCLAIR 2712 has inferior sealing properties when compared to Examples 2, 3, 4, and 5, where the closure is made from SCLAIR 2710, SCLAIR 2807, SCLAIR 2908, SCLAIR 2907 respectively. For Example 1, only 10% of the closures passed the secure seal test at a pressure of more than 175 psi for more than 1 minute, while the pass rate for Examples 2-5 ranged between 50% and 90%.

Removal Torque Test

This is an International Society of Beverage Technologists (ISBT) voluntary standard test. It is used to determine the torque required to remove a closure from a container.

After filling and capping a PET bottle with 4.2 GV of $CO_2$ as described above, the bottle was conditioned for 24 hours at room temperature (22° C.+/−1° C.) prior to conducting the removal torque test. The total application angle used for testing was 740°. The maximum removal torque was tested using a Steinfurth automated torque measuring machine with a proper chuck at the speed of 0.8 rpm/minute. A total of twelve tests were carried out for each of Examples 1 to 3 and the average results are provided in Table 8.

TABLE 8[1]

Removal Torque of a PET bottle - PE closure System (closure has additives for color, 1% red, and slip, 1000 ppm by way of 2% masterbatch).

| Example | Average (in-lb) | Std. Dev. (in-lb) | Minimum (in-lb) | Maximum (in-lb) |
|---|---|---|---|---|
| 1, Comp. | 12.6 | 0.88 | 11.7 | 14.4 |
| 2 | 13.1 | 1.40 | 11.4 | 15.4 |
| 3 | 12.3 | 0.81 | 11.4 | 13.5 |
| 4 | 12.1 | 1.47 | 10.4 | 15.6 |
| 5 | 14.4 | 0.69 | 13.2 | 15.9 |

Note
[1]PET bottle used: CSD, PCO 1881 neck finish, 591 ml.

Examination of the data in Table 8, shows that Examples 1-5 have variable removal torque values, but where, Examples 5, which is a unimodal homopolymer of ethylene was slightly better than the rest with an average removal torque values of 14.4 inches per pound, which is indicative of improved sealing properties.

Ball Impact Test

This is an International Society of Beverage Technologists (ISBT) voluntary standard test. During transportation and use by the consumer, a beverage closure can experience impact forces. The ball impact test evaluates the tendency of the closure to remain on a container opening without release. The test was carried out as follows. After filling and capping a PET bottle-closure system with 4.2 GV of $CO_2$ as described above, the bottle-closure system was conditioned for 24 hours in a temperature controlled chamber at 4° C. Ball impact testing was conducted using Steinfurth Ball impact tester which holds the bottle-closure system against movement with the bottle-closure system held in a desired orientation. A steel ball (286.7 g, 41.27 mm in diameter) was used as the impacting object. The steel ball was dropped from a height of 762 mm (30 inches) at four different orientations; at 00 to the top center of the closure, at 900 to the top edge of the closure, at 450 to top edge of the closure, and at 900 to the sidewall edge of the closure. After the impact test, the bottle-closure system was removed from the impact tester and the closure was checked for damage and/or leakage. A total of ten ball impact tests were carried out at each angle for each of Examples 1 to 5 and the results are provided in Table 9.

TABLE 9[1]

Ball Impact Test of PET bottle - PE closure System (closure has additives for color, 1% red, and slip, 1000 ppm by way of 2% masterbatch).

| Example | 0° to top center of closure No. of failure (% of pass) | 90° to top edge of closure No. of failure (% of pass) | 45° angle to top edge of closure No. of failure (% of pass) | 90° to sidewall edge of closure No. of failure (% of pass) | Total No. of failures (% of pass) |
|---|---|---|---|---|---|
| 1, Comp. | 0 (100%) | 7 (30%) | 1 (90%) | 4 (60%) | 12 (70%) |
| 2 | 0 (100%) | 1 (90%) | 2 (80%) | 1 (90%) | 4 (90%) |
| 3 | 0 (100%) | 6 (40%) | 4 (60%) | 1 (90%) | 11 (72.5%) |
| 4 | 0 (100%) | 6 (40%) | 4 (60%) | 1 (90%) | 11 72.5% |
| 5 | 0 (100%) | 8 (20%) | 0 (100%) | 0 (100%) | 8 (80%) |

Note
[1]PET bottle used: CSD, PCO 1881 neck finish, 591 ml.

The data in Table 9 show that there are relatively minor differences between Examples 1, 3, 4 and 5, but with Example 1 having the poorest overall performance. Example 2 seems to have a marked improvement over the others with respect to when the ball impact test is carried out at 90° to the top edge of the closure, passing that particular test 90 percent of the time.

Neutron Activation Analysis (NAA)

Neutron Activation Analysis, hereafter NAA, was used to determine catalyst residues in ethylene polymers and was performed as follows. A radiation vial (composed of ultra-pure polyethylene, 7 mL internal volume) was filled with an ethylene polymer product sample and the sample weight was recorded. Using a pneumatic transfer system the sample was placed inside a SLOWPOKE™ nuclear reactor (Atomic Energy of Canada Limited, Ottawa, Ontario, Canada) and irradiated for 30 to 600 seconds for short half-life elements (e.g., Ti, V, Al, Mg, and Cl) or 3 to 5 hours for long half-life elements (e.g. Zr, Hf, Cr, Fe and Ni). The average thermal neutron flux within the reactor was $5\times10^{11}/cm^2/s$. After irradiation, samples were withdrawn from the reactor and aged, allowing the radioactivity to decay; short half-life elements were aged for 300 seconds or long half-life elements were aged for several days. After aging, the gamma-ray spectrum of the sample was recorded using a germanium semiconductor gamma-ray detector (Ortec model GEM55185, Advanced Measurement Technology Inc., Oak Ridge, Tenn., USA) and a multichannel analyzer (Ortec model DSPEC Pro). The amount of each element in the sample was calculated from the gamma-ray spectrum and recorded in parts per million relative to the total weight of the ethylene polymer sample. The N.A.A. system was calibrated with Specpure standards (1000 ppm solutions of the desired element (greater than 99% pure)). One mL of solutions (elements of interest) were pipetted onto a 15 mm×800 mm rectangular paper filter and air dried. The filter paper was then placed in a 1.4 mL polyethylene irradiation vial and analyzed by the N.A.A. system. Standards are used to determine the sensitivity of the N.A.A. procedure (in counts/μg).

Examples 1-5 employ the unimodal polymers as described above. Comparative examples 6-9 are commercially available polymers having a melt index, $I_2$ ranging from about 1.5 to about 11.0 g/10 min and densities ranging from about 0.951 g/cm$^3$ to about 0.955 g/cm$^3$, and which may be used to make closures and which were similarly subjected to NAA analysis.

TABLE 10

NAA of Polyethylene Polymers

| Example | Al (ppm) | Cl (ppm) | Mg (ppm) | Ti (ppm) |
|---|---|---|---|---|
| 1, Comp. | 0.1 | 0.05 | <1 | 0.133 |
| 2 | 0.19 | 0.11 | <1 | 0.16 |
| 3 | 0.58 | 0.1 | <2 | 0.69 |
| 4 | 0.511 | 0.074 | <1 | 0.288 |
| 5 | 0.96 | 0.14 | <2 | 0.19 |
| 6, Comp. | 66.3 | 20.2 | 3.61 | 7.27 |
| 7, Comp. | 65.2 | 32.6 | 4.05 | 12.19 |
| 8, Comp. | 25.1 | 9.54 | 2.89 | 0.923 |
| 9, Comp. | 26.2 | 11.3 | 3.97 | 1.01 |

The data provided in Table 10, shows that the resins employed in Examples 1-5 have much reduced residual catalyst component levels (e.g. aluminum, chlorine, magnesium and titanium) when compared to several other commercially available products (Examples 6 through 9). Compare for example, Examples 2-5 which have less than 1 ppm of aluminum (Al), and less than 0.7 ppm of titanium (Ti) present (where "ppm" is parts per million of element per mass of polymer, e.g. milligrams of element/kilograms of polymer) with Examples 6-10 which have Al levels of from about 25 ppm to about 66 ppm, and Ti levels of from about 1 to about 11 ppm. Examples 2-5 also have much lower levels of chlorine (Cl) and magnesium (Mg), which don't exceed about 0.15 ppm and 2 ppm respectively.

For end use applications, especially those that are used at elevated temperatures and which may come in contact with foodstuff it may be desirable to employ products having lower levels of catalyst component residues. Lower catalyst residues may lead to better organoleptic properties and help preserve the original taste and odor of the packaged contents.

Non-limiting embodiments of the present disclosure include the following:

Embodiment A

A process to fill a container, the process comprising: adding a hot liquid to the container through a container opening, sealing the container opening with a closure comprising a unimodal polyethylene composition, and bringing the hot liquid into contact with an interior surface of the closure; wherein the unimodal polyethylene composition has a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

Embodiment B

The process of Embodiment A wherein the unimodal polyethylene composition is an ethylene homopolymer.

Embodiment C

The process of Embodiment A or B wherein the unimodal polyethylene composition has a density of from 0.958 to 0.963 g/cm$^3$.

Embodiment D

The process of Embodiment A, B or C wherein the unimodal polyethylene composition has a melt index, $I_2$ of from 3.0 to 12.0 g/10 min.

Embodiment E

The process of Embodiment A wherein the unimodal polyethylene composition is a copolymer of ethylene and an alpha olefin.

Embodiment F

The process of Embodiment A or E wherein the unimodal polyethylene composition has a density of from 0.948 to 0.958 g/cm$^3$.

Embodiment G

The process of Embodiment A, E or F wherein the unimodal polyethylene composition has a melt index, $I_2$ of from 4.0 to 20.0 g/10 min.

Embodiment H

The process of Embodiment A, E, F or G wherein the unimodal polyethylene composition is a copolymer of ethylene and an alpha olefin selected from 1-butene, 1-hexene and 1-octene.

Embodiment I

The process of Embodiment A, B, C, D, E, F, G, or H wherein the unimodal polyethylene composition further comprises a nucleating agent or a mixture of nucleating agents.

Embodiment J

The process of Embodiment A wherein the unimodal polyethylene composition is prepared by contacting ethylene and optionally an alpha-olefin with a polymerization catalyst under solution polymerization conditions.

Embodiment K

The process of Embodiment A, B, C, D, E, F, G, H, I or J wherein the closure is made by continuous compression molding or injection molding.

Embodiment L

The process of Embodiment A, B, C, D, E, F, G, H, I, J or K wherein the unimodal polyethylene composition is made with a Ziegler-Natta catalyst.

Embodiment M

The process of Embodiment A, B, C, D, E, F, G, H, I, J, K or L wherein the unimodal polyethylene composition has less than 0.8 ppm of titanium present.

Embodiment N

The process of Embodiment A, B, C, D, E, F, G, H, I, J, K, L, or M wherein the unimodal polyethylene composition has an ESCR Condition B (10% IGEPAL) of at least 1 hour.

Embodiment O

Use of a closure in a hot fill process, wherein the closure comprises a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

Embodiment P

The use according to Embodiment O wherein the unimodal polyethylene composition is an ethylene homopolymer.

Embodiment Q

The use according to Embodiment O or P wherein the unimodal polyethylene composition has a density of from 0.958 to 0.963 g/cm$^3$.

Embodiment R

The use according to Embodiment O, P or Q wherein the unimodal polyethylene composition has a melt index, $I_2$ of from 3.0 to 12.0 g/10 min.

Embodiment S

The use according to Embodiment O wherein the unimodal polyethylene composition is a copolymer of ethylene and an alpha olefin.

Embodiment T

The use according to Embodiment O or S wherein the unimodal polyethylene composition has a density of from 0.948 to 0.958 g/cm$^3$.

Embodiment U

The use according to Embodiment O, S or T wherein the unimodal polyethylene composition has a melt index, $I_2$ of from 4.0 to 20.0 g/10 min.

Embodiment V

The use according to Embodiment O, S, T or U wherein the unimodal polyethylene composition is a copolymer of ethylene and an alpha olefin selected from 1-butene, 1-hexene and 1-octene.

Embodiment W

The use according to Embodiments O, P, Q, R, S, T, U or V wherein the unimodal polyethylene composition further comprises a nucleating agent or a mixture of nucleating agents.

Embodiment X

The use according to claim O wherein the unimodal polyethylene composition is prepared by contacting ethylene and optionally an alpha-olefin with a polymerization catalyst under solution polymerization conditions.

Embodiment Y

The use according to Embodiments O, P, Q, R, S, T, U, V, W or X wherein the closure is made by continuous compression molding or injection molding.

Embodiment Z

The use according to Embodiments O, P, Q, R, S, T, U, V, W, X or Y wherein the unimodal polyethylene composition is made with a Ziegler-Natta catalyst.

Embodiment AA

The use according to Embodiments O, P, Q, R, S, T, U, V, W, X, Y or Z wherein the unimodal polyethylene composition has less than 0.8 ppm of titanium present.

Embodiment BB

The use according to Embodiments O, P, Q, R, S, T, U, V, W, X, Y, Z or AA wherein the unimodal polyethylene composition has an ESCR Condition B (10% IGEPAL) of at least 1 hour.

Embodiment CC

A process to fill a container, the process comprising: adding a hot liquid to the container through a container opening; sealing the container opening with a closure comprising a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2; and bringing the hot liquid into contact with an interior surface of the closure; wherein the closure has a time exponent, m of 0.114 or less where m is determined using a compressive strain model represented by the equation:

$$\varepsilon = A \times \sigma^n \times t^m$$

where ε is the compressive strain; σ is the stress in $N/cm^2$, t is the loading time in seconds, A is the model coefficient, n is the deformation stress exponent and m is the time exponent.

Embodiment DD

Use of a closure in a hot fill process, wherein the closure comprises a unimodal polyethylene composition having a density from 0.945 to 0.967 $g/cm^3$; a melt index, $I_2$ of from 2.5 to 20.0 g/10 min; a weight average molecular weight (Mw) from 25,000 to 85,000 g/mol; a molecular weight distribution $M_w/M_n$ of from 2.2 to 4.2; wherein the closure has a time exponent, m of 0.114 or less, where m is determined using a compressive strain model represented by the equation:

$$\varepsilon = A \times \sigma^n \times t^m$$

where ε is the compressive strain; σ is the stress in $N/cm^2$, t is the loading time in seconds, A is the model coefficient, n is the deformation stress exponent and m is the time exponent.

The present invention has been described with reference to certain details of particular embodiments thereof. It is not intended that such details be regarded as limitations upon the scope of the invention except insofar as and to the extent that they are included in the accompanying claims.

What is claimed is:

1. A process to fill a container, the process comprising: adding a hot liquid to the container through a container opening, sealing the container opening with a closure comprising a unimodal polyethylene composition, and bringing the hot liquid into contact with an interior surface of the closure; wherein the unimodal polyethylene composition has a density from 0.945 to 0.967 $g/cm^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

2. The process of claim 1 wherein the unimodal polyethylene composition is an ethylene homopolymer.

3. The process of claim 2 wherein the unimodal polyethylene composition has a density of from 0.958 to 0.963 $g/cm^3$.

4. The process of claim 3 wherein the unimodal polyethylene composition has a melt index, $I_2$ of from 3.0 to 12.0 g/10 min.

5. The process of claim 2 wherein the unimodal polyethylene composition has a melt index, $I_2$ of from 3.0 to 12.0 g/10 min.

6. The process of claim 1 wherein the unimodal polyethylene composition is a copolymer of ethylene and an alpha olefin.

7. The process of claim 6 wherein the unimodal polyethylene composition has a density of from 0.948 to 0.958 $g/cm^3$.

8. The process of claim 7 wherein the unimodal polyethylene composition has a melt index, $I_2$ of from 4.0 to 20.0 g/10 min.

9. The process of claim 8 wherein the unimodal polyethylene composition is a copolymer of ethylene and an alpha olefin selected from 1-butene, 1-hexene and 1-octene.

10. The process of claim 7 wherein the unimodal polyethylene composition is a copolymer of ethylene and an alpha olefin selected from 1-butene, 1-hexene and 1-octene.

11. The process of claim 6 wherein the unimodal polyethylene composition has a melt index, $I_2$ of from 4.0 to 20.0 g/10 min.

12. The process of claim 11 wherein the unimodal polyethylene composition is a copolymer of ethylene and an alpha olefin selected from 1-butene, 1-hexene and 1-octene.

13. The process of claim 6 wherein the unimodal polyethylene composition is a copolymer of ethylene and an alpha olefin selected from 1-butene, 1-hexene and 1-octene.

14. The process of claim 1 wherein the unimodal polyethylene composition further comprises a nucleating agent or a mixture of nucleating agents.

15. The process of claim 1 wherein the unimodal polyethylene composition is prepared by contacting ethylene and optionally an alpha-olefin with a polymerization catalyst under solution polymerization conditions.

16. The process of claim 1 wherein the closure is made by continuous compression molding or injection molding.

17. The process of claim 1 wherein the unimodal polyethylene composition is made with a Ziegler-Natta catalyst.

18. The process of claim 1 wherein the unimodal polyethylene composition has less than 0.8 ppm of titanium present.

19. The process of claim 1 wherein the unimodal polyethylene composition has an ESCR Condition B (10% IGEPAL) of at least 1 hour.

20. Use of a closure in a hot fill process, wherein the closure comprises a unimodal polyethylene composition having a density from 0.945 to 0.967 $g/cm^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2.

21. The use according to claim 20 wherein the unimodal polyethylene composition is a homopolymer.

22. The use according to claim 21 wherein the unimodal polyethylene composition has a density of from 0.958 to 0.963 $g/cm^3$.

23. The use according to claim 22 wherein the unimodal polyethylene composition has a melt index, $I_2$ of from 3.0 to 12.0 g/10 min.

24. The use according to claim 21 wherein the unimodal polyethylene composition has a melt index, $I_2$ of from 3.0 to 12.0 g/10 min.

25. The use according to claim 20 wherein the unimodal polyethylene composition is a copolymer of ethylene and an alpha olefin.

26. The use according to claim 25 wherein the unimodal polyethylene composition has a density of from 0.948 to 0.958 $g/cm^3$.

27. The use according to claim 26 wherein the unimodal polyethylene composition has a melt index, $I_2$ of from 4.0 to 20.0 g/10 min.

28. The use according to claim 27 wherein the unimodal polyethylene composition is a copolymer of ethylene and an alpha olefin selected from 1-butene, 1-hexene and 1-octene.

29. The use according to claim 26 wherein the unimodal polyethylene composition is a copolymer of ethylene and an alpha olefin selected from 1-butene, 1-hexene and 1-octene.

30. The use according to claim 25 wherein the unimodal polyethylene composition has a melt index, $I_2$ of from 4.0 to 20.0 g/10 min.

31. The use according to claim 30 wherein the unimodal polyethylene composition is a copolymer of ethylene and an alpha olefin selected from 1-butene, 1-hexene and 1-octene.

32. The use according to claim 25 wherein the unimodal polyethylene composition is a copolymer of ethylene and an alpha olefin selected from 1-butene, 1-hexene and 1-octene.

33. The use according to claim 20 wherein the unimodal polyethylene composition further comprises a nucleating agent or a mixture of nucleating agents.

34. The use according to claim 20 wherein the unimodal polyethylene composition is prepared by contacting ethylene and optionally an alpha-olefin with a polymerization catalyst under solution polymerization conditions.

35. The use according to claim 20 wherein the closure is made by continuous compression molding or injection molding.

36. The use according to claim 20 wherein the unimodal polyethylene composition is made with a Ziegler-Natta catalyst.

37. The use according to claim 20 wherein the unimodal polyethylene composition has less than 0.8 ppm of titanium present.

38. The use according to claim 20 wherein the unimodal polyethylene composition has an ESCR Condition B (10% IGEPAL) of at least 1 hour.

39. A process to fill a container, the process comprising: adding a hot liquid to the container through a container opening; sealing the container opening with a closure comprising a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; and a molecular weight distribution $M_w/M_n$ of from 2.2 to 4.2; and bringing the hot liquid into contact with an interior surface of the closure; wherein the closure has a time exponent, m of 0.114 or less where m is determined using a compressive strain model represented by the equation:

$$\varepsilon = A \times \sigma^n \times t^m$$

where ε is the compressive strain; σ is the stress in N/cm$^2$, t is the loading time in seconds, A is the model coefficient, n is the deformation stress exponent and m is the time exponent.

40. Use of a closure in a hot fill process, wherein the closure comprises a unimodal polyethylene composition having a density from 0.945 to 0.967 g/cm$^3$; a melt index, $I_2$ of from 2.5 to 20.0 g/10 min; a weight average molecular weight (Mw) from 25,000 to 85,000 g/mol; a molecular weight distribution $M_w/M_n$ of from 2.2 to 4.2; wherein the closure has a time exponent, m of 0.114 or less, where m is determined using a compressive strain model represented by the equation:

$$\varepsilon = A \times \sigma^n \times t^m$$

where ε is the compressive strain; σ is the stress in N/cm$^2$, t is the loading time in seconds, A is the model coefficient, n is the deformation stress exponent and m is the time exponent.

* * * * *